US007471051B1

(12) United States Patent
Wacknov et al.

(10) Patent No.: US 7,471,051 B1
(45) Date of Patent: Dec. 30, 2008

(54) ADVANCED LOW VOLTAGE LIGHTING SYSTEM

(75) Inventors: Joel Wacknov, Westlake Village, CA (US); Randall W. Brumbaugh, Monrovia, CA (US); Paul D. Chancellor, Simi Valley, CA (US); Kenneth W. Keller, Reseda, CA (US); David J. McShane, Westlake Village, CA (US)

(73) Assignee: Avatar Systems LLC, Westlake Village, CA (US)

( * ) Notice: Subject to any disclaimer, the term of this patent is extended or adjusted under 35 U.S.C. 154(b) by 606 days.

(21) Appl. No.: 11/234,940

(22) Filed: Sep. 26, 2005

Related U.S. Application Data

(60) Provisional application No. 60/613,008, filed on Sep. 24, 2004.

(51) Int. Cl.
*G05F 1/00* (2006.01)

(52) U.S. Cl. ..... 315/291; 315/318; 315/362; 315/297; 315/294

(58) Field of Classification Search ..... 315/291, 315/294, 297, 307, 224, 312, 316, 318, 360, 315/362
See application file for complete search history.

(56) References Cited

U.S. PATENT DOCUMENTS

| | | | | |
|---|---|---|---|---|
| 6,166,496 | A * | 12/2000 | Lys et al. | 315/316 |
| 6,426,611 | B1 * | 7/2002 | Reeves et al. | 323/267 |
| 6,548,967 | B1 * | 4/2003 | Dowling et al. | 315/318 |
| 7,202,613 | B2 * | 4/2007 | Morgan et al. | 315/312 |
| 7,233,115 | B2 * | 6/2007 | Lys | 315/291 |

* cited by examiner

*Primary Examiner*—Haissa Philogene
(74) *Attorney, Agent, or Firm*—Ocean Law; Paul D. Chancellor, Esq.

(57) ABSTRACT

Disclosed is a lighting system supporting multiple independently controlled zones utilizing a plurality of semiconductor switches coupled to a plurality of transformers to produce a non-sinusoidal power output and controlled by a digital controller that receives feedback from each zone in order to auto-sense the proper voltage for a plurality of connected loads.

14 Claims, 21 Drawing Sheets

100

600

700

800a

800b

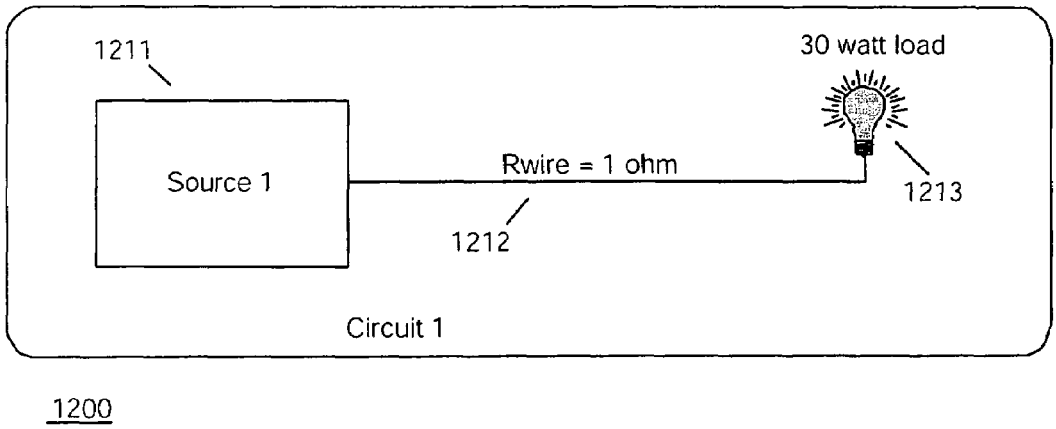
FIGURE 12
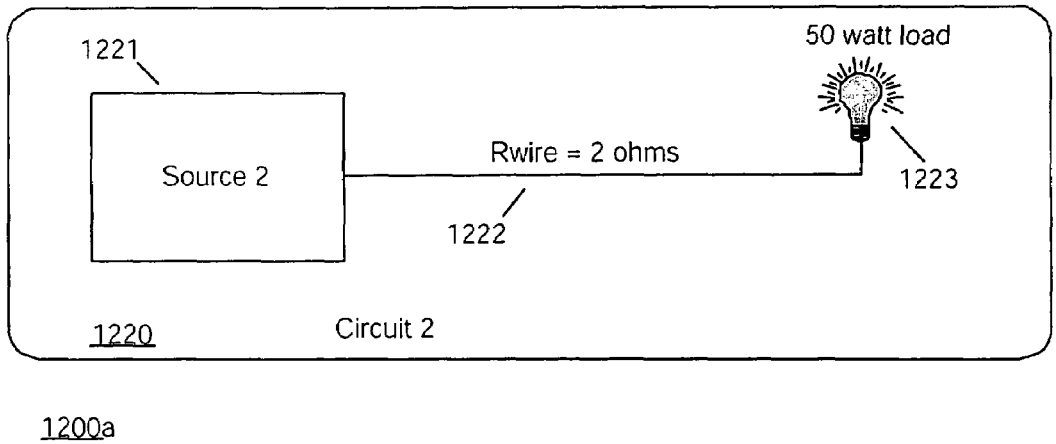
FIGURE 12a1

| | Source voltage | Source current (amps) | Lamp voltage | Source voltage % | Lamp voltage % | Lamp intensity % |
|---|---|---|---|---|---|---|
| Assby. 1 | 14.50 | 2.50 | 12.00 | 100% | 100% | 100% |
| Assby. 2 | 20.33 | 4.17 | 12.00 | 100% | 100% | 100% |

FIGURE 12a

| | Source voltage | Source current (amps) | Lamp voltage | Source voltage % | Lamp voltage % | Lamp intensity % |
|---|---|---|---|---|---|---|
| Assby. 1 | 7.25 | 1.64 | 5.58 | 50.0% | 46.5% | 6.9% |
| Assby. 2 | 10.17 | 2.58 | 5.01 | 50.0% | 41.8% | 4.7% |

FIGURE 12b

| | Source voltage | Source current (amps) | Lamp voltage | Source voltage % | Lamp voltage % | Lamp intensity % |
|---|---|---|---|---|---|---|
| Assby. 1 | 7.71 | 1.71 | 6.00 | 53.2% | 50.0% | 8.8% |
| Assby. 2 | 10.81 | 2.69 | 5.43 | 53.2% | 45.3% | 6.2% |

FIGURE 12c

| | Source voltage | Source current (amps) | Lamp voltage | Source voltage % | Lamp voltage % | Lamp intensity % |
|---|---|---|---|---|---|---|
| Assby. 1 | 7.71 | 1.71 | 6.00 | 53.2% | 50.0% | 8.8% |
| Assby. 2 | 11.69 | 2.85 | 6.00 | 57.5% | 50.0% | 8.8% |

FIGURE 12d

ADVANCED LOW VOLTAGE LIGHTING SYSTEM

CROSS REFERENCE TO RELATED APPLICATIONS

This application claims the benefit of and incorporates by reference U.S. Provisional Application 60/613,008 filed Sep. 24, 2004 and entitled ADVANCED EXTERIOR LIGHTING SYSTEM.

BACKGROUND OF THE INVENTION

1. Field of the Invention

The present invention pertains to the electrical arts. More particularly, the present invention pertains to systems and methods for providing a low voltage lighting system.

2. Description of the Related Art

Low voltage incandescent lighting systems are well known in this country. Typical applications include indoor specialty, task and feature lighting and outdoor landscape lighting. Since Edison's invention of the "Electric-Lamp" and Tesla's pioneering work on transformers in the 1880's, the technology required to build similar low voltage lighting systems has been available. Mass production and more recently the proliferation of low cost manufacturers overseas have placed low voltage lighting systems within the economic reach of virtually every homeowner.

Despite the success of low voltage lighting systems in the marketplace, their technological evolution has been slow. Having experienced only small advances such as longer life bulbs and the addition of mechanical timers to "high-end" transformers, today's low voltage lighting systems are little changed from those made over fifty years ago. Most commonly, a network of electric circuits is still used to directly interconnect a transformer and "Electric-Lamps".

There are a number of good reasons to find improvements over the Edison/Tesla solution. First is that the present system is wasteful. Utilization of an AC power source in low voltage power circuits results in high circuit currents. This problem frequently cannot be cured by simply raising the source voltage. The result is that conductors within a circuit that have the capacity to carry the required power are nevertheless unable to do so when a voltage limitation is imposed. The common solution is that larger conductors are used and valuable resources are wasted.

The second reason to seek out improvements over the traditional technology is that installers have problems installing these systems. Because high currents flow in the circuits interconnecting the bulbs and the transformer, unacceptably large voltage drops frequently occur during installation. Even experienced installers can be forced to adopt a trial-and-error approach to relocating bulbs, pulling more wire, and perhaps changing transformer taps if they are available. Because of this problem, the man-hour cost of installing low voltage lighting systems is increased. In addition, the installer's cure for the excessive voltage drop problem often wastes resources in the form of more wire, larger transformers, and/or additional transformers.

A final reason to improve on what has been done for so many years is that traditional low voltage lighting systems reach only a fraction of their potential to please homeowners and onlookers. Because traditional systems typically utilize a single transformer, all the bulbs are turned either on or off. Even in systems with multiple transformers, there is no facility to coordinate their operation or to vary bulb intensity at will. Those who have installed multiple transformers with integral timers will recognize that it is this lack of coordination problem that requires them to reset not just one, but multiple timers after a power outage.

SUMMARY OF THE INVENTION

Now in accordance with the present invention, there have been found systems and methods which provide low voltage lighting systems with improved utilization of conductor capacity, installation successes on the first try, and increased pleasure to viewers.

The invention provides an improved voltage limited, low voltage lighting system including a power supply and a lighting network. A variable electric power output of the power supply is electrically coupled to an input of the lighting or load network and a means for obtaining an indication of an electrical characteristic of the lighting or load network is provided. Also included is a controller for adjusting a waveform at the electrical output wherein the controller is responsive to an indication of a selected electrical characteristic of the lighting or load network.

Lighting systems in accordance with the present invention may be realized by coupling networks having specific functions. As an example, an alternating current power source may supply power to a first network including a variable power supply that is coupled to a second network including various electrical loads.

Also provided is a method of reducing the quantity of a conductor such as copper required to implement a low voltage lighting system. A power output of a first electrical network is coupled to a power input of a second electrical network and the first electrical network receives power from an alternating current source. Controlling a semiconductor switch within the first electrical network varies, within a power range, the power exchanged between the first and second electrical networks. A low voltage electrical device is operated within the second electrical network from power supplied by the first electrical network wherein for at least a portion of the power range, the ratio of the maximum instantaneous voltage to RMS voltage as measured at the power output is less than 1.414.

In an embodiment is a method of regulating a remote electrical device. An electrical output of a variable power supply is coupled to an electrical input of a lighting network and the variable power supply receives power from an alternating current source. A waveform at the electrical output is varied and for a plurality of waveforms there is obtained an indication of the corresponding voltages and currents at the lighting network input. The impedance of an electrical conductor within the lighting network is inferred form the indicated voltages and currents and this inferred impedance of the electrical conductor is utilized to regulate the power supplied to the lighting network.

In another embodiment the lighting system receives power from an alternating current source. A plurality of network power supplies have respective electric power outputs that are coupled to electric power inputs of respective lighting networks. Each network power supply is operative to supply a plurality of electric power waveforms to a respective lighting network. A controller in signal communication with a plurality of the network power supplies is operative to select for each network power supply a particular electric power output waveform that is independent of the electric power output waveforms selected for the other network power supplies.

BRIEF DESCRIPTION OF THE DRAWINGS

The novel features of this invention will be best understood from the accompanying description, in which similar characters refer to similar parts, and in which:

FIGS. 12 and 12*a*1 are lighting assemblies of the lighting system of FIG. 1.

FIGS. 12*a-d* are tabulated data for the lighting assemblies of FIGS. 12 and 12*a*1.

DESCRIPTION OF THE PREFERRED EMBODIMENTS

Figure 1:
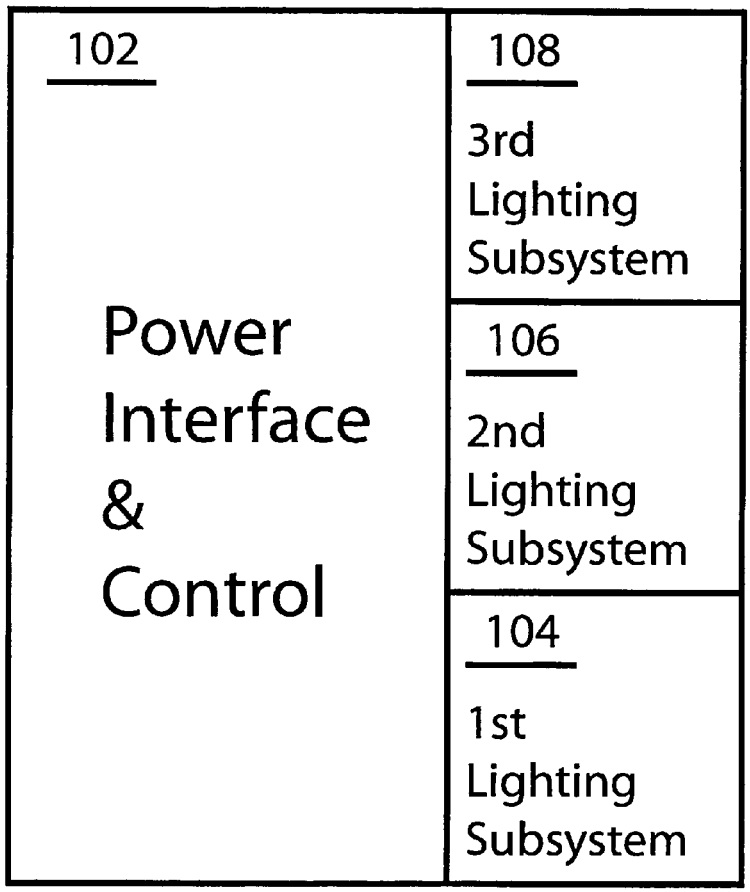
FIG. 1 is a block diagram of a lighting system in accordance with the present invention.

FIG. 1 shows a lighting system 100 in accordance with the present invention. A power, interface, and control block 102 is electrically connected to lighting subsystems 104, 106, 108.

Figure 2:
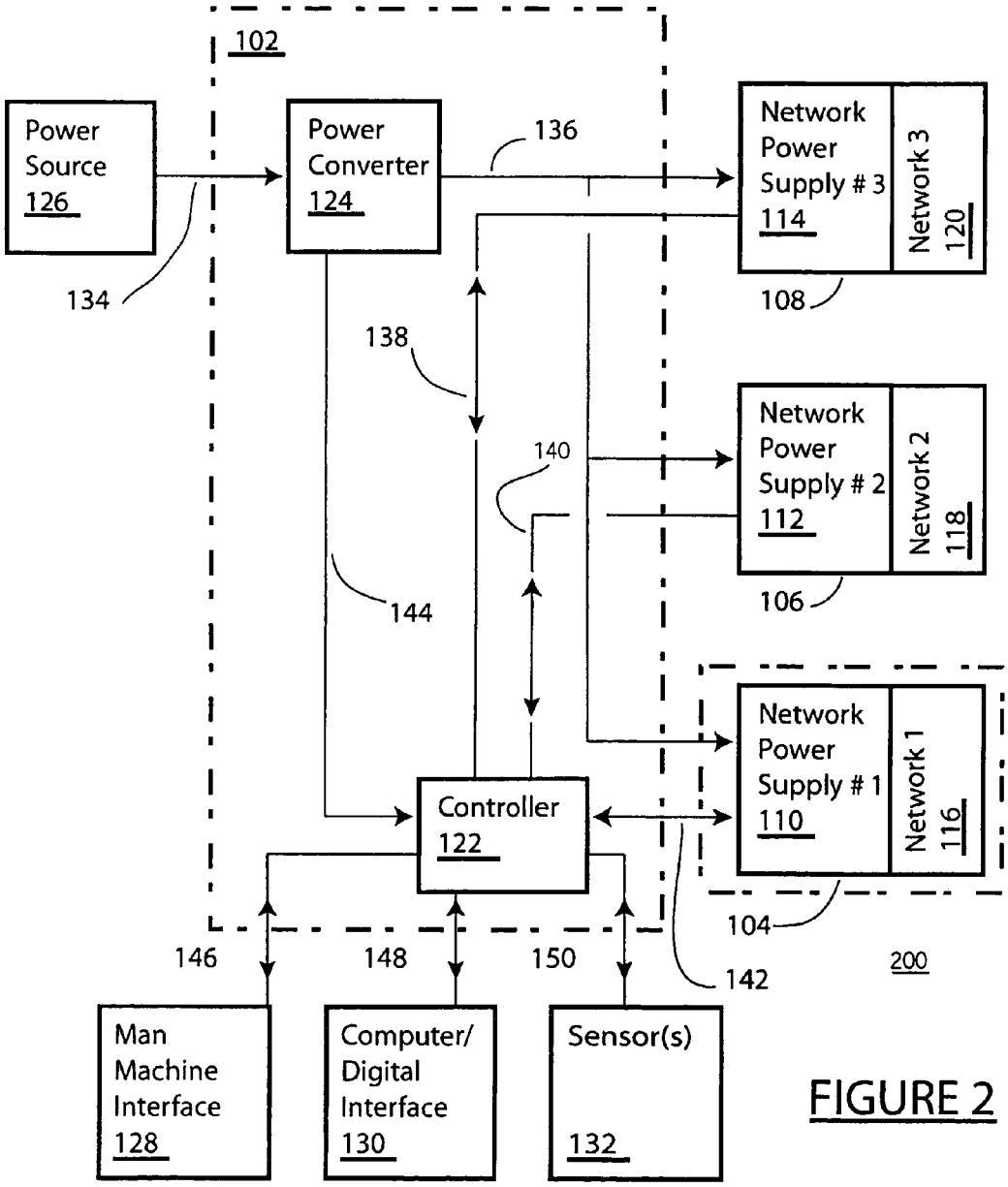
FIG. 2 is a block diagram of an embodiment of the lighting system of FIG. 1.

FIG. 2 shows an embodiment 200 of the lighting system 100. Here, the power, interface, and the control block 102 includes a power converter 124, a controller 122, and a plurality of circuits for making interconnections. A first power circuit 134 supplies power from a power source 126 to the power converter. A second power circuit 144 supplies power from the power converter to the controller. A third power circuit 136 interconnects respective first, second, and third network power supplies 110, 112, 114 with the power converter. First, second, and third bidirectional signal circuits 142, 140, 138 interconnect respective first, second, and third network power supplies 110, 112, 114 with the controller. Fourth, fifth, and sixth bidirectional signal circuits 146, 148, 150 interconnect respectively a man machine interface 128, a computer/digital interface 130, and sensor(s) 132 with the controller.

In some embodiments, the controller includes multiple controllers or control elements. Communication methods among these controllers include hardwired interconnections, wireless interconnection methods including radio frequency signals and optical signals in the visible or invisible light wavebands, and hybrid interconnections utilizing both hardwired and wireless interconnections. Examples of hardwired interconnections include RS485, RS232, Ethernet, USB, ModBus, CanBus, ProfiBus, Modem, Serial, and Parallel. Examples of wireless interconnection methods include Zigbee, 802.11, 802.11x, WiFi, and Bluetooth. Hybrid interconnections include X-10 and systems that utilize conventional AC power wiring as a signal exchange medium.

With continued reference to FIG. 2, first, second, and third lighting subsystems 104, 106, 108 include respective network power supplies 110, 112, 114 for supplying electric power to respective first, second, and third electrical load networks 116, 118, 120. In some embodiments the load networks include loads such as lighting devices including incandescent, tungsten filament, tungsten-halogen, fluorescent, electro luminescent, and light emitting diodes. In other embodiments the load networks include devices such as electric motors, semiconductor switches, drivers and networks that employ these devices, and linear non-lighting loads. Each of these configurations is another embodiment of the present invention.

Figure 2A:
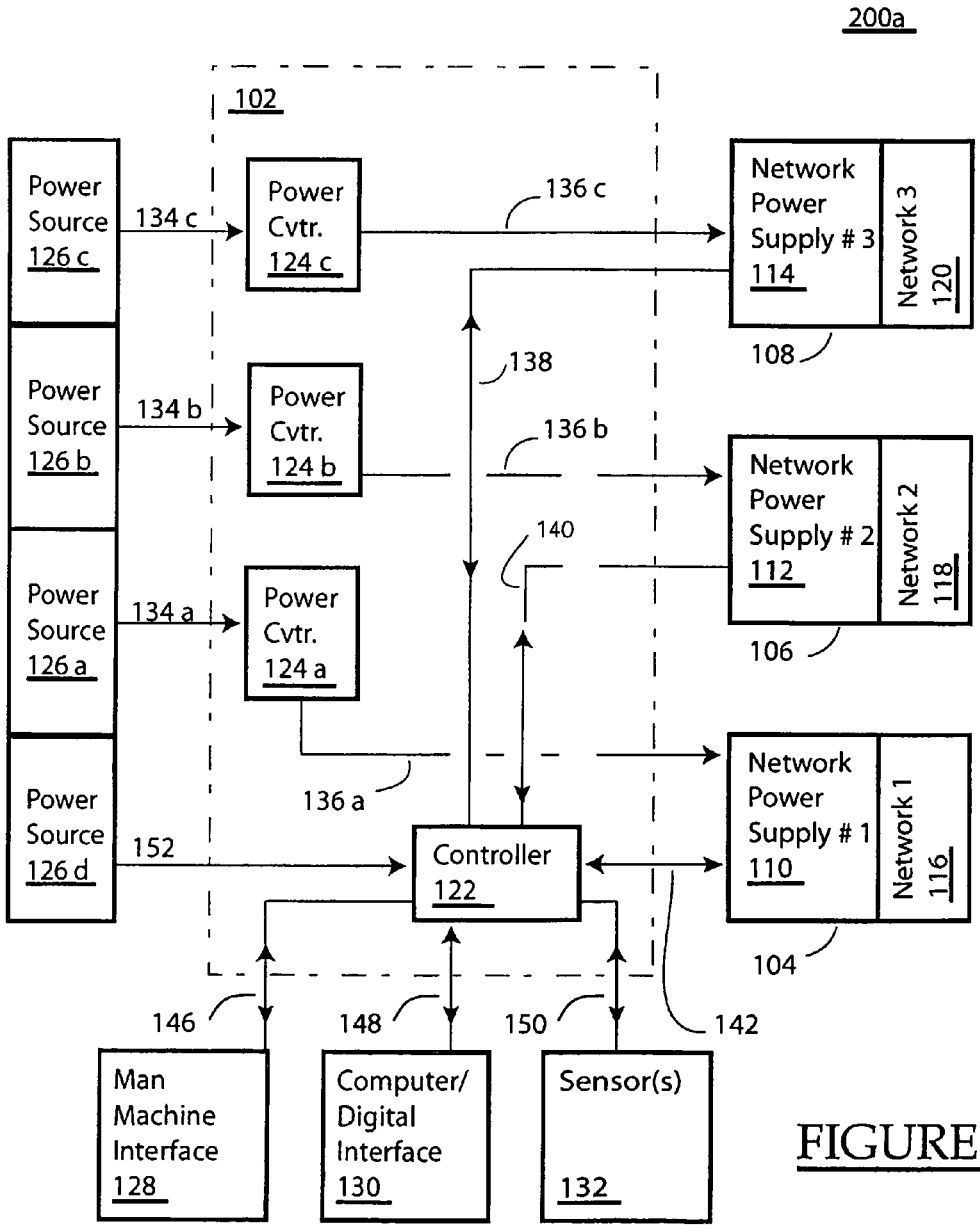
FIG. 2*a* is a block diagram of an embodiment of the lighting system of FIG. 1.

FIG. 2*a* shows a another embodiment 200*a* of the lighting system 100. In this embodiment the single power source 126 and the single power converter 124 of FIG. 2 are replaced by respective power sources and power converters for each network power supply. First power circuits 134*a*, 134*b*, 134*c* supply power from respective power sources 126*a*, 126*b*, 126*c* to respective power converters 124*a*, 134*b*, 134*c*. Third power circuits 136*a*, 136*b*, 136*c* supply power from respective power converters to respective network power supplies 110, 112, 114. The controller power circuit 152 supplies power from the controller power source 126*d* to the controller 122. In other embodiments, the power sources 126*a-d* are combined such that fewer than four power sources are used. In some embodiments, the power converters 124*a-c* are combined such that fewer than three power converters are used.

Figure 3:
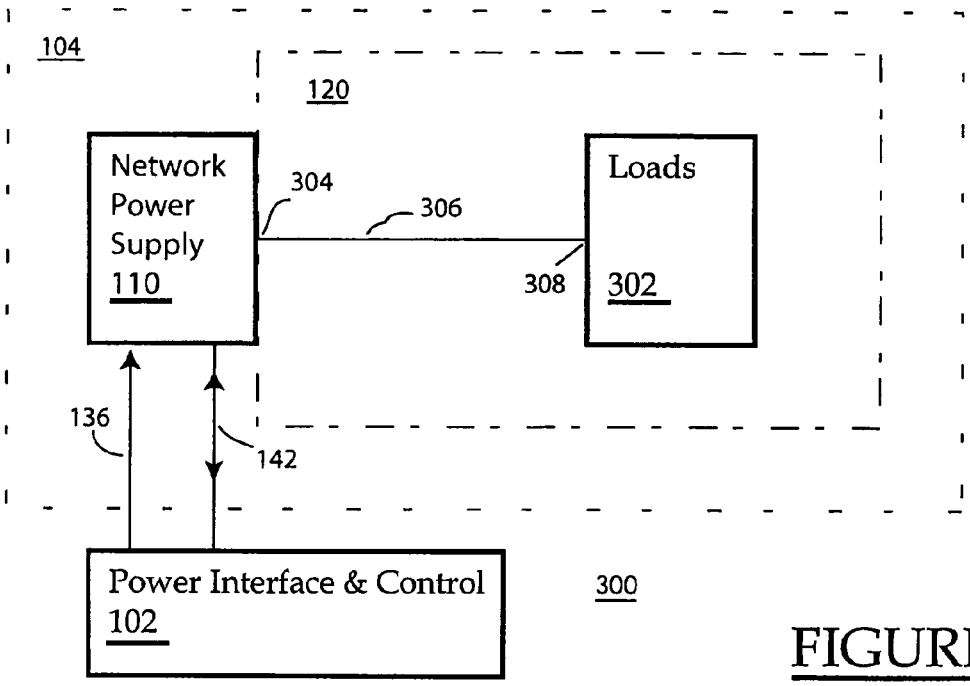
FIG. 3 is a block diagram of an embodiment of a lighting subsystem of the lighting system of FIG. 1.

FIG. 3 shows an embodiment 300 of the first lighting subsystem 104. The first lighting subsystem 104 includes the first load network 120 and the first network power supply 110. Included in the first load network is a first trunk circuit 306 and a first load 302. First trunk circuit 306 couples a power output 304 of the first network power supply 110 and a power input 308 of the load 302. In an embodiment, the load 302 includes a plurality of discrete loads powered from the power input of the load network. In some embodiments a plurality of trunk circuits may be included, each trunk circuit supplying a respective power input of a respective load.

Figure 4:
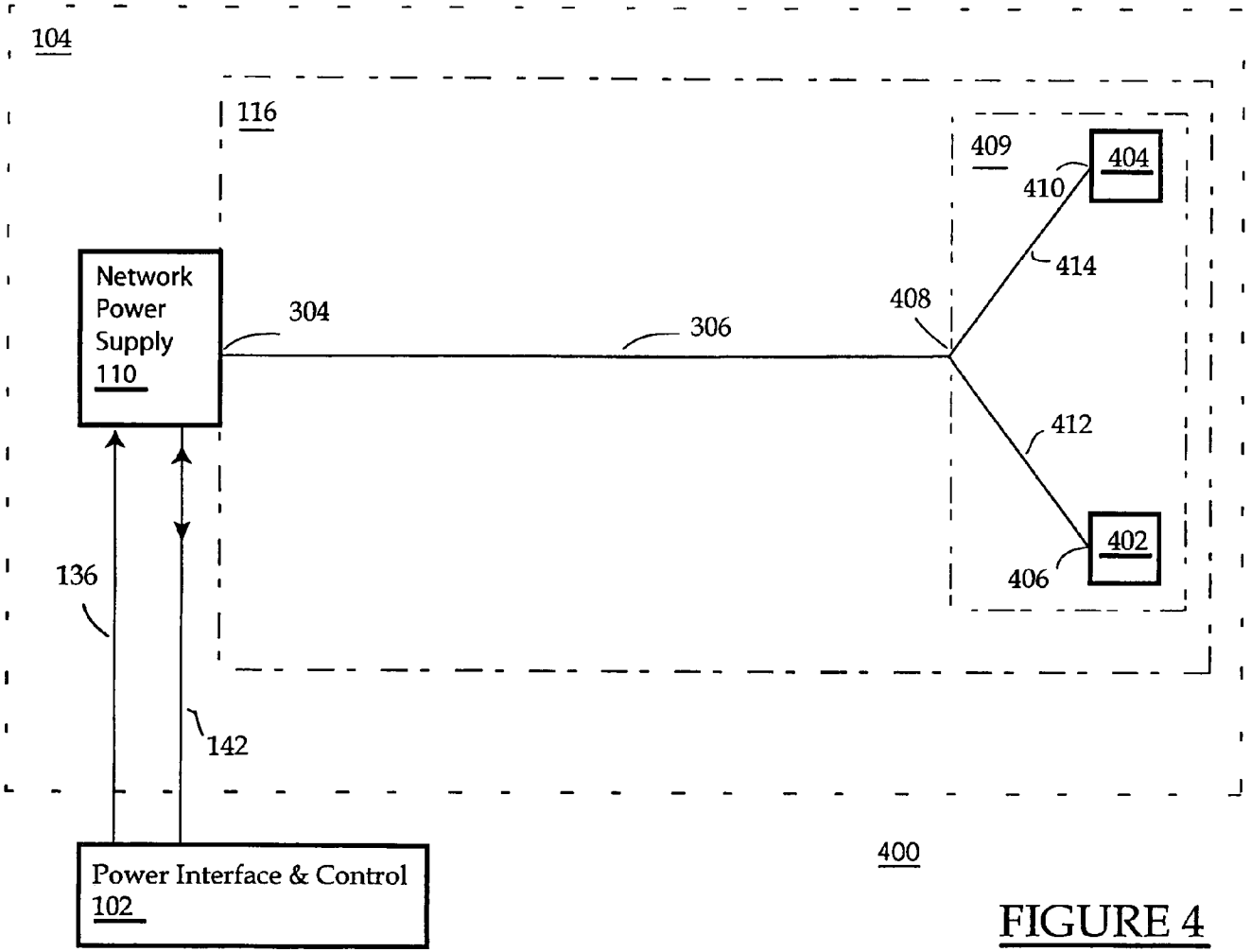
FIG. 4 is a block diagram of an embodiment of a lighting subsystem of the lighting system of FIG. 1.

FIG. 4 shows another embodiment 400 of the first lighting subsystem 104. The first lighting subsystem 104 includes the first load network 116 and the first network power supply 110. Included in the first load network is a first trunk circuit 306 and a first load distribution network 409. The first trunk circuit coules the power output of the first network power supply 304 and a power input of the load distribution network 408. Within the load distribution network branch circuits 412, 414 radially interconnect power inputs 406, 410 of respective loads 402, 404 with the power input of the load distribution network. The loads may include a plurality of discrete loads powered from their respective power inputs.

Figure 4A:
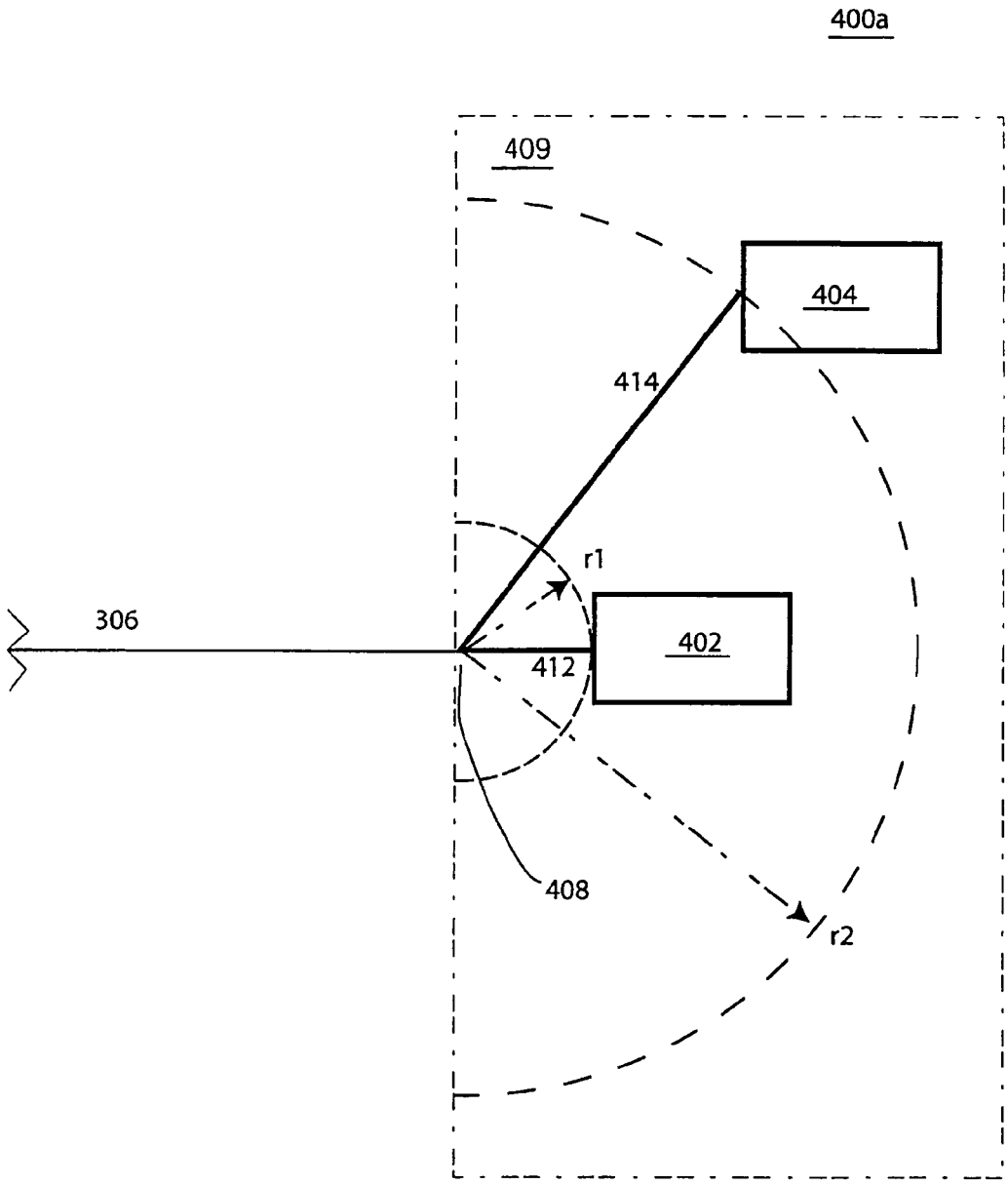
FIG. 4*a* is a schematic of an embodiment of a distribution network of the lighting system of FIG. 1.

FIG. 4*a* shows an embodiment 400*a* of the load distribution network 409. Here, the loads 402, 404 are interconnected with the power input of the load distribution network 408 by respective branch circuits 412, 414 having respective cable lengths of r1 and r2.

As a person of ordinary skill in the art will recognize, the number of branch circuits connected to the electrical input of the load distribution network 409 will vary with the number of loads to be supported. Further, in some embodiments the lighting subsystems 104, 106, 108 employ the configuration shown in FIG. 3, 4 or 4*a*, or another similar configuration. Each of these configurations is another embodiment of the present invention.

Figure 5:
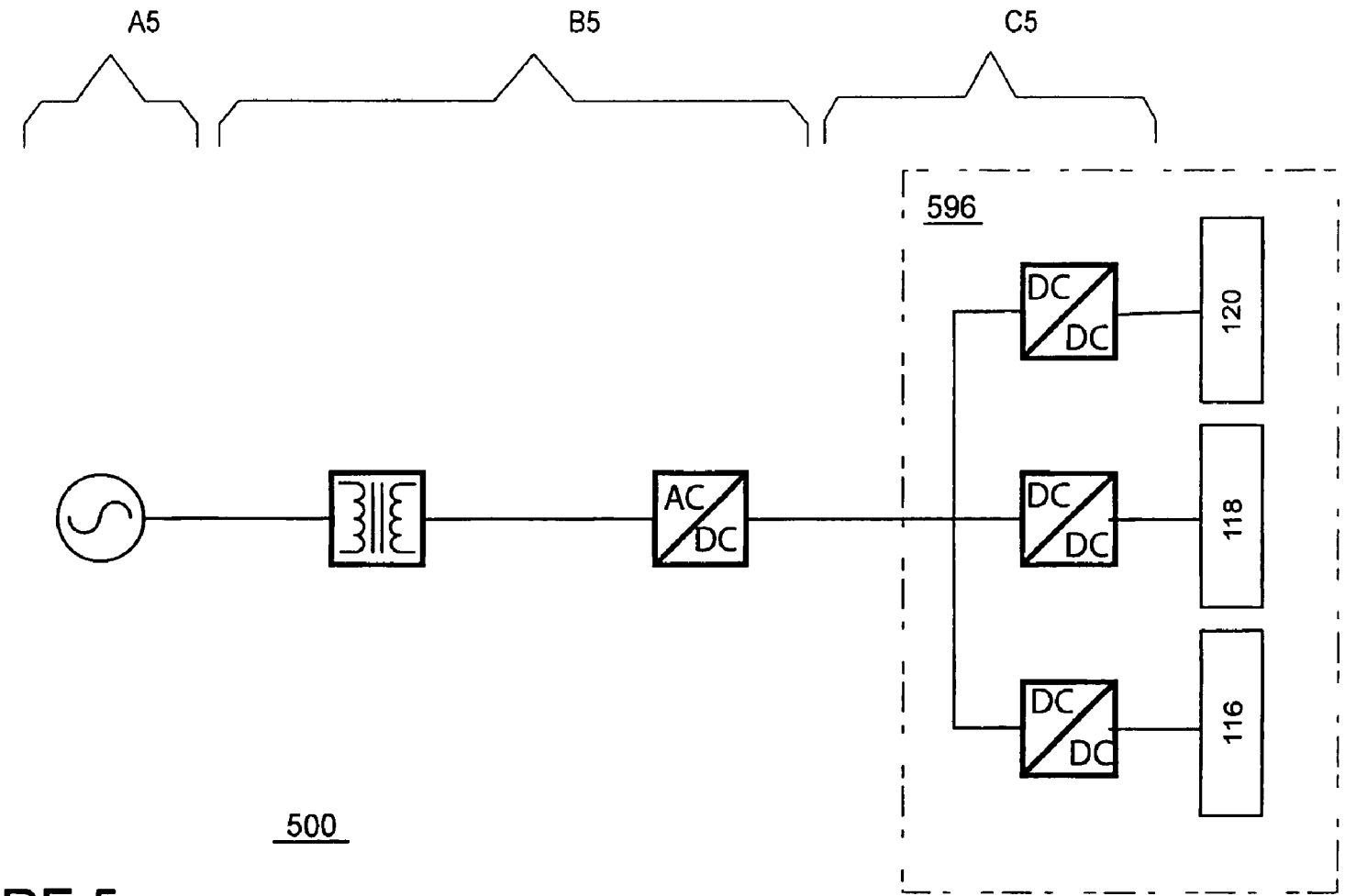
FIG. 5 is a block diagram of a first power structure of the lighting system of FIG. 1.
Figure 6:
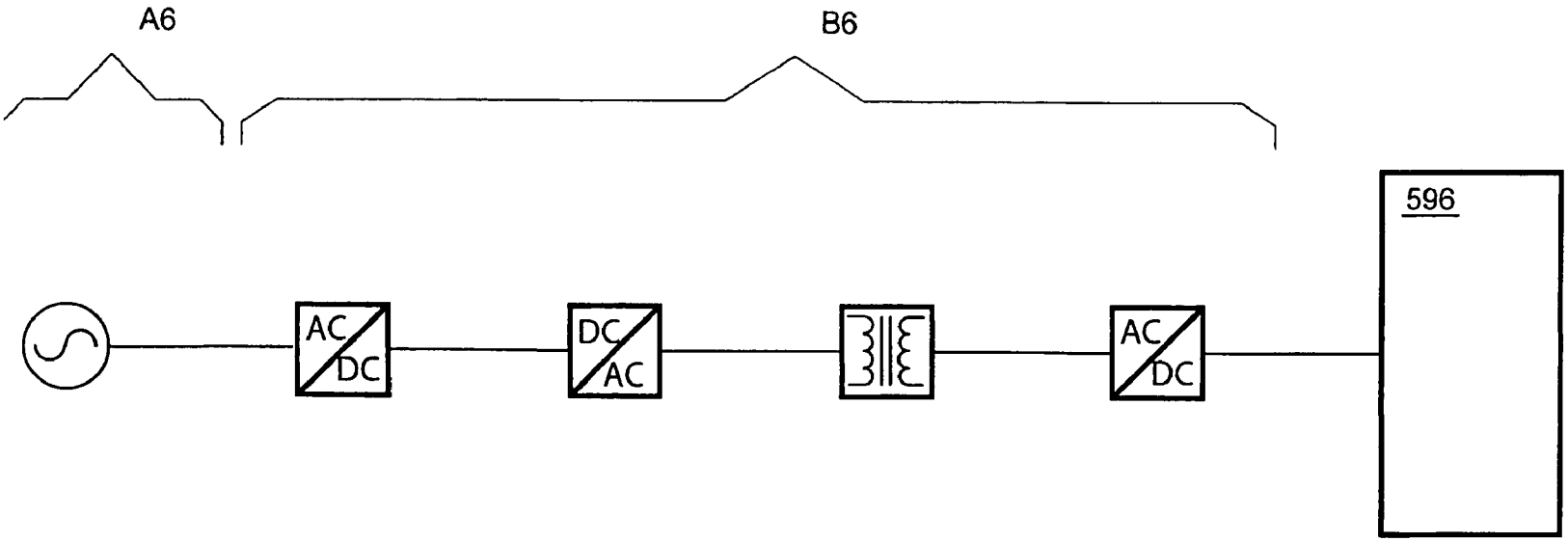
FIG. 6 is a block diagram of a second power structure of the lighting system of FIG. 1.
Figure 7:
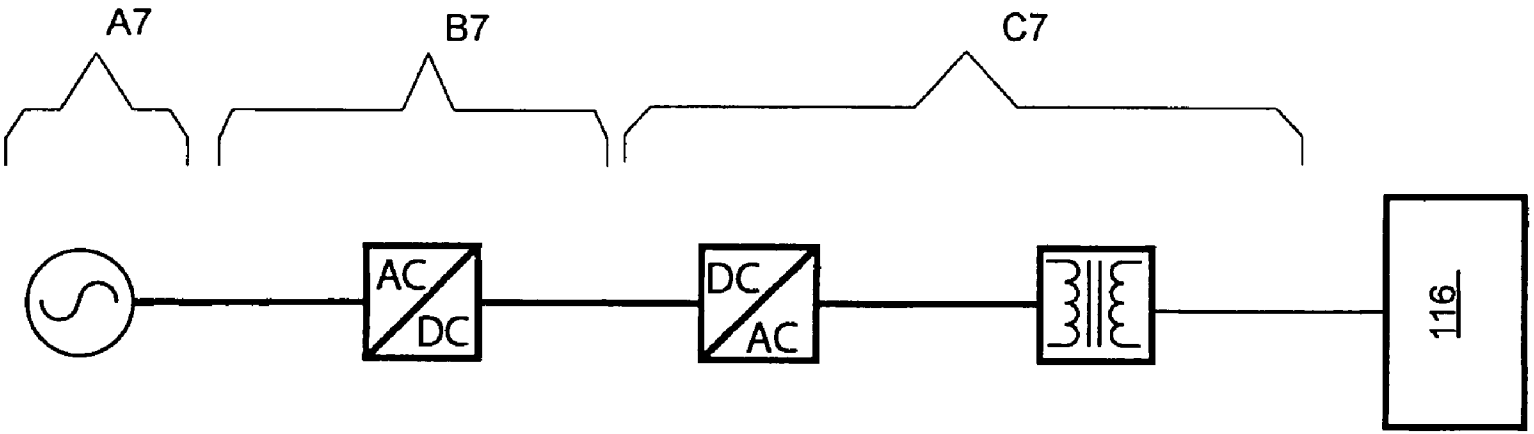
FIG. 7 is a block diagram of a third power structure of the lighting system of FIG. 1.

The lighting system 100 may utilize various configurations of interconnected power sources 126, power converters 124 and network power supplies 110, 112, 114 to supply power to the load networks 116, 118, 120. Particular configurations are referred to herein as power structures. In addition, each power structure may be implemented to include particular electrical realizations and/or components. FIGS. 5-7 show three such power structures and related implementations of each. As a person of ordinary skill in the art will recognize, the power structures are themselves an assemblage of one or more electrical networks and other configurations and implementations may be utilized without departing from the scope of the invention disclosed herein.

FIG. 5 shows a first power structure 500 of the lighting system 100. The first power structure includes interconnected sections A5, B5, and C5. Referring to FIGS. 2 and 5, first, second, and third sections A5, B5, C5 form respectively the power source 126, the power converter 124, and the network power supplies 110, 112, 114. Section A5 is an AC power source supplying Section B5. Section B5 includes a transformer supplying power to an AC to DC converter. Section C5 includes a plurality of DC to DC converters (three shown) that receive the DC output of Section B5 and supply power to respective lighting subsystems 116, 118, 120. As shown, section C5 and respective coupled load networks 116, 118, 120 comprise a first network power supply and load network block 596. In some embodiments, the transformer is replaced with an AC to AC converter that may or may not provide electrical isolation.

Figure 5A:
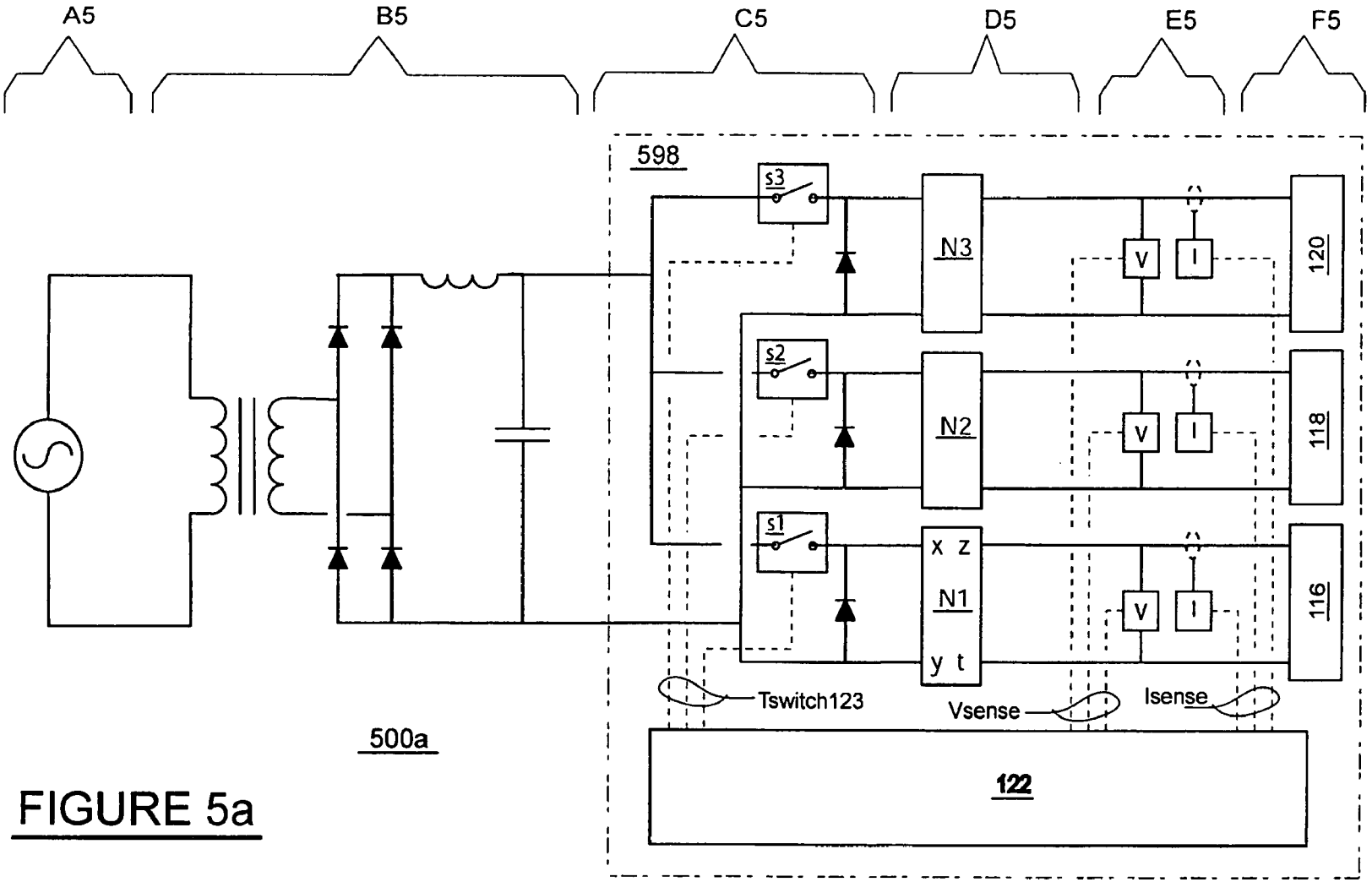
FIG. 5*a* is a schematic diagram of an embodiment of the first power structure of the lighting system of FIG. 1.

FIG. 5*a* shows an embodiment 500*a* of the first power structure 500. Section A5 includes a 120 VAC source. Section B5 includes a transformer having a primary winding that receives power from Section A5 and a secondary winding that is interconnected to Section C5 by a full wave bridge rectifier with LC output filtering. Section C5 comprises a plurality of network power supplies 110, 112, 114. Each network power supply includes a respective power semiconductor switch s1, s2, s3 such as a Field Effect Transistor driving a high frequency buck converter that supplies power to a respective load network 116, 118, 120 in Section F5 via respective intermediate networks N1, N2, N3 in Section D5. In an embodiment, the intermediate networks are filters and in some embodiments the filters are realized as LC filters. Among other things, such filters reduce the harmonic energy transferred to the load networks and consequently the radiation of electromagnetic energy from them. In another embodiment, the intermediate networks are merely conductors that interconnect Sections C5 and ES. In Section ES, voltages and currents at or near the inputs to the load networks 304 are sensed or indicated to provide respective indications of Vsense and Isense. As shown, Sections C5, D5, E5, and F5 comprise a second network power supply and load network block 598. As shown in FIGS. 2 and 2*a*, the controller 122 is interconnected with each of the network power supplies via respective circuits or pluralities of circuits 138, 140, 142. As shown in this embodiment, the controller is coupled to the power structure via interconnecting switch circuits Tswitch123, voltage sensing circuits Vsense, and current sensing circuits Isense. In some embodiments, Section B5 may be configured with optional power factor correction as discussed infra.

FIG. 6 shows a second power structure 600 of the lighting system 100. The 30 second power structure includes interconnected sections A6, B6, and C6 (see also FIG. 5).

Referring to FIGS. 2 and 6, first, second, and third sections A6, B6, C6 form respectively the power source 126, the power converter 124, and the network power supplies 110, 112, 114. Section A6 is an AC power source supplying Section B6. Section B6 includes a DC to AC converter receiving power from a first AC to DC converter and providing power to a transformer that provides power to a second AC to DC converter. The first AC to DC converter of Section B6 receives power from Section A6 and the second AC to DC converter of Section B6 provides power to the first network power supply and load network block 596 (see FIG. 5). In some embodiments, the transformer is replaced with an AC to AC converter that may or may not provide electrical isolation.

Figure 6A:
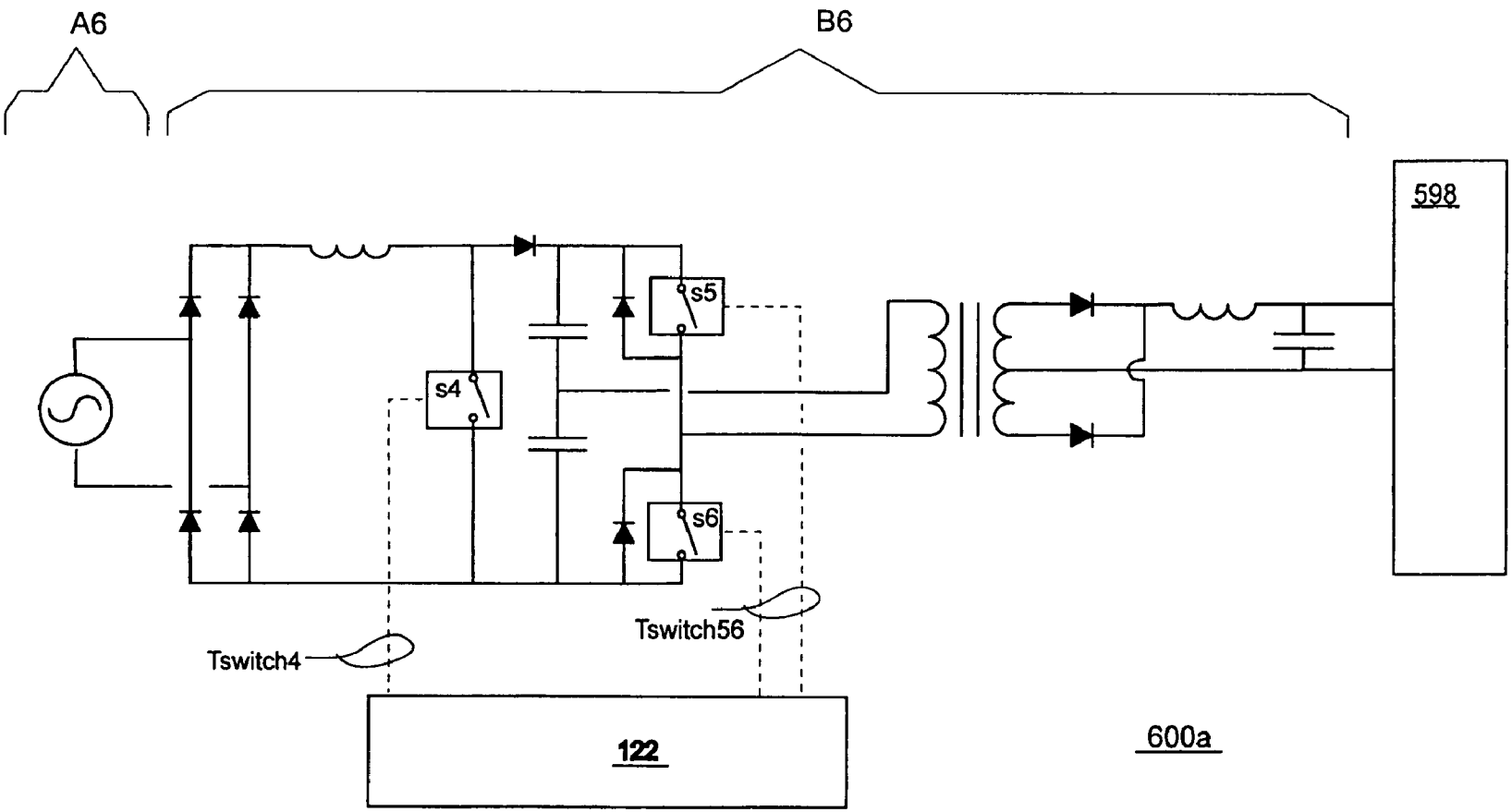
FIG. 6*a* is a schematic diagram of an embodiment of the second power structure of the lighting system of FIG. 1.

FIG. 6*a* shows an embodiment 600*a* of the second power structure 600. Section A6 includes an AC source. Section B6 includes a unity power factor front end coupling the AC source to a DC to AC converter. Also in Section B6 is a transformer receiving power from the DC to AC converter and supplying power to block 598 via an AC to DC converter with a filtered output. The front end comprises a full wave bridge rectifier that supplies power to a boost converter utilizing a first semiconductor switch s4. The DC to AC converter receives power from the front end into a center tapped capacitive energy storage device which supplies power to the primary winding of a transformer via two second semiconductor switches s5, s6. The AC to DC converter receives power from a center tapped secondary winding of the transformer and provides power to second network power supply and load network block 598 (see FIG. 5*a*) via an LC output filter. As shown in this embodiment, the controller is also coupled to first and second semiconductor switches via circuits Tswitch4 and Tswitch56. In other embodiments, first and second semiconductor switches are coupled to another control device.

FIG. 7 shows a third power structure 700 of the lighting system 100. Here, a plurality of third power structures are interconnected with respective lighting subsystems. The third power structure includes interconnected sections A7, B7, and C7. Referring to FIGS. 2 and 2*a*, first, second, and third sections A7, B7, C7 form respectively the power source 126, the power converter 124, and a network power supply 110. Section A7 is an AC power source supplying Section B7. Section B7 includes an AC to DC converter providing power to Section C7. Section C7 includes a DC to AC converter that is coupled to a load network 116 via a transformer. In some embodiments, the transformer is replaced with an AC to AC converter that may or may not provide electrical isolation.

Figure 7A:
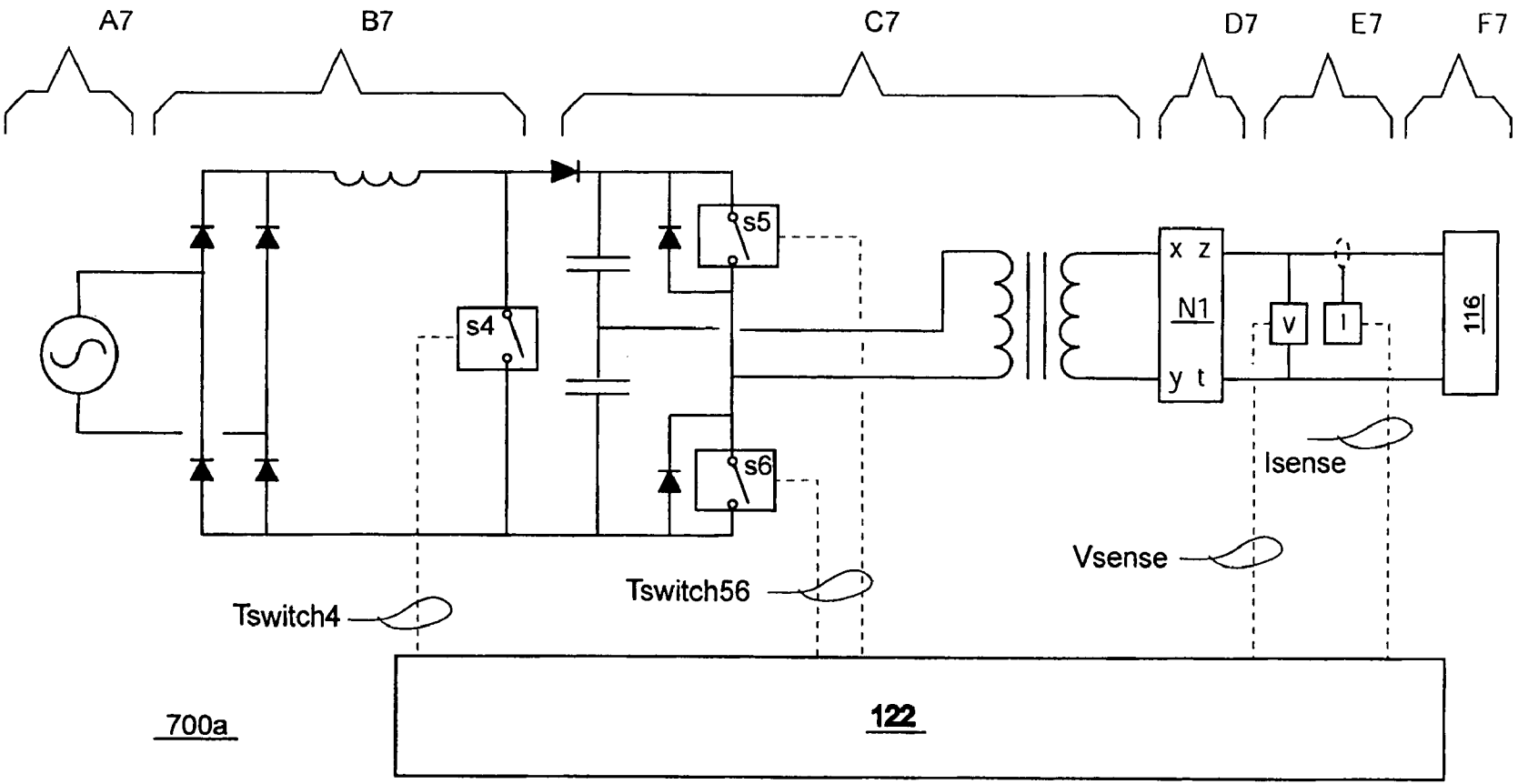
FIG. 7*a* is a schematic diagram of an embodiment of the third power structure of the lighting system of FIG. 1.

FIG. 7*a* shows an embodiment 700*a* of the third power structure 700. Section A7 includes an AC source. Section B7 includes a unity power factor front end receiving power from Section A7 and providing power to Section C7. The front end comprises a full wave bridge rectifier that supplies power to a boost converter utilizing a first semiconductor switch s4. Section C7 comprises a DC to AC converter that receives power from the front end into a center tapped capacitive energy storage device which supplies power to the primary of a transformer via two second semiconductor switches s5, s6. An intermediate network N1 in Section D7 receives the power from a secondary of the transformer and transfers power to the load network 116 in Section F7 via Section E7. In an embodiment, the intermediate network is a filter and in some embodiments the filter is realized as an LC filter. In another embodiment, the intermediate networks are merely conductors serving to interconnect Sections C7 and E7. Sensors and or indicating means in section E7 provide indications of voltage Vsense and current Isense at the input of the load network 304 to the controller 122. As shown in FIGS. 2 and 2*a*, the controller 122 is interconnected with the network power supply 110 via circuit 142. As shown in this embodiment, the controller is coupled to the power structure via interconnecting switch circuits Tswitch4, Tswitch56, voltage sensing circuits Vsense, and current sensing circuits Isense. In other embodiments, another control device is connected to one or both of the first and second semiconductor switches.

As a person of ordinary skill in the art will recognize, the power structure used in particular lighting systems 100 may incorporate one or more of the power structures 500, 500*a*, 600, 600*a*, 700, 700*a* or portions of the power structure discussed supra.

Figure 8:
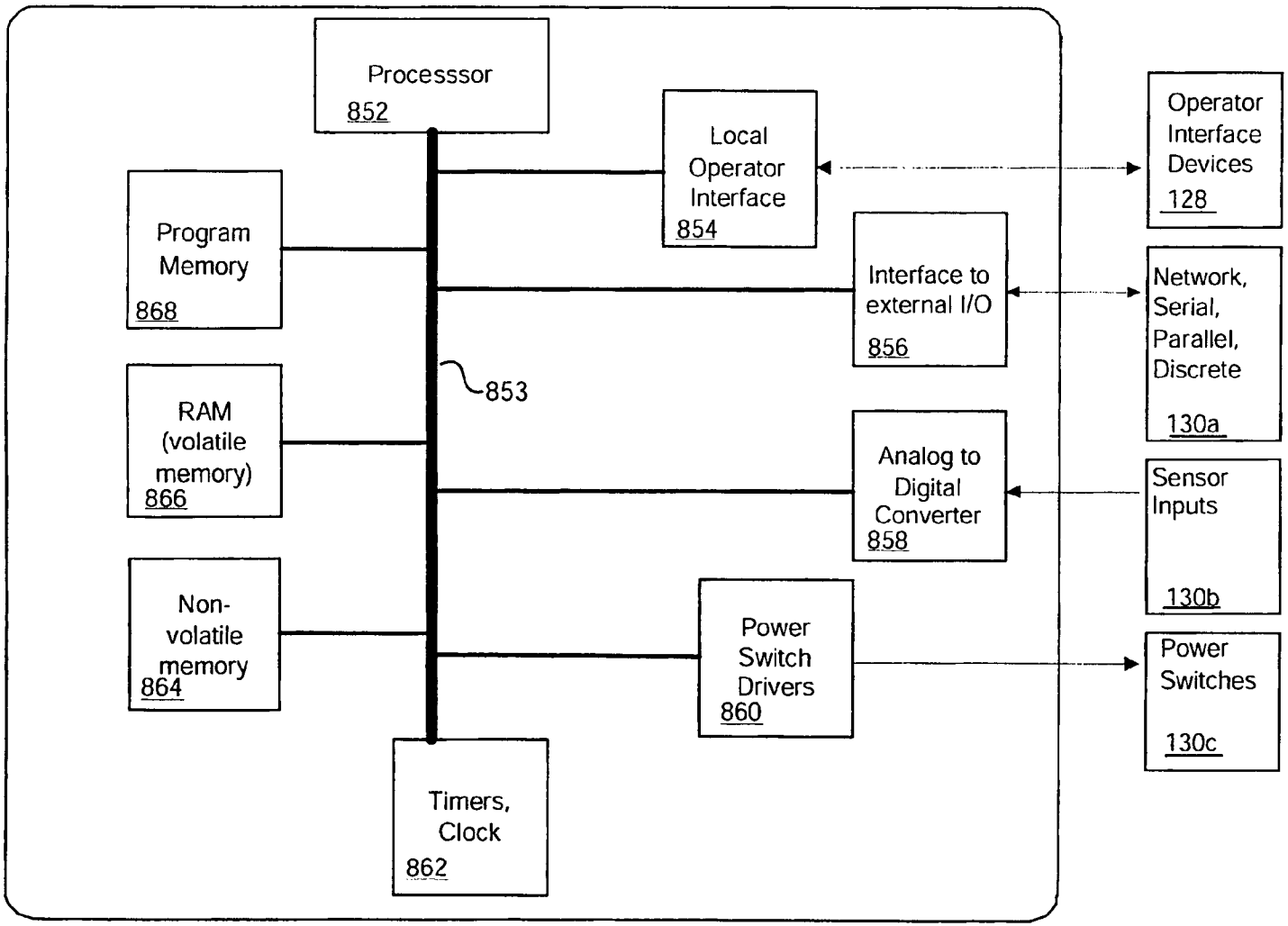
FIG. 8 is a block diagram of an embodiment of a controller of the lighting system of FIG. 1.

FIG. 8 shows an embodiment 800 of the controller 122. Here, the controller includes a bus 853 interconnecting memory, timers 862 and input/output interfaces. Memory includes program memory 868, volatile RAM memory 866, and non-volatile memory 864. Input/output interfaces include a local operator interface 854, interface to external input/output 856, analog to digital converter for sensor input/output 858, and power switch drivers 860 for driving external devices. As a person of ordinary skill in the art will understand, one or more of each of these devices may be incorporated into a single controller and/or replicated where elements of the controller are replicated to realize and/or support a plurality of functions or external input/output. One or more of these devices may be implemented in a single component or in multiple interconnected components. An example of a suitable hardware controller is the PIC18F8720 microcontroller available from Microchip Technology Incorporated of Chandler, Ariz.

Figure 8A:
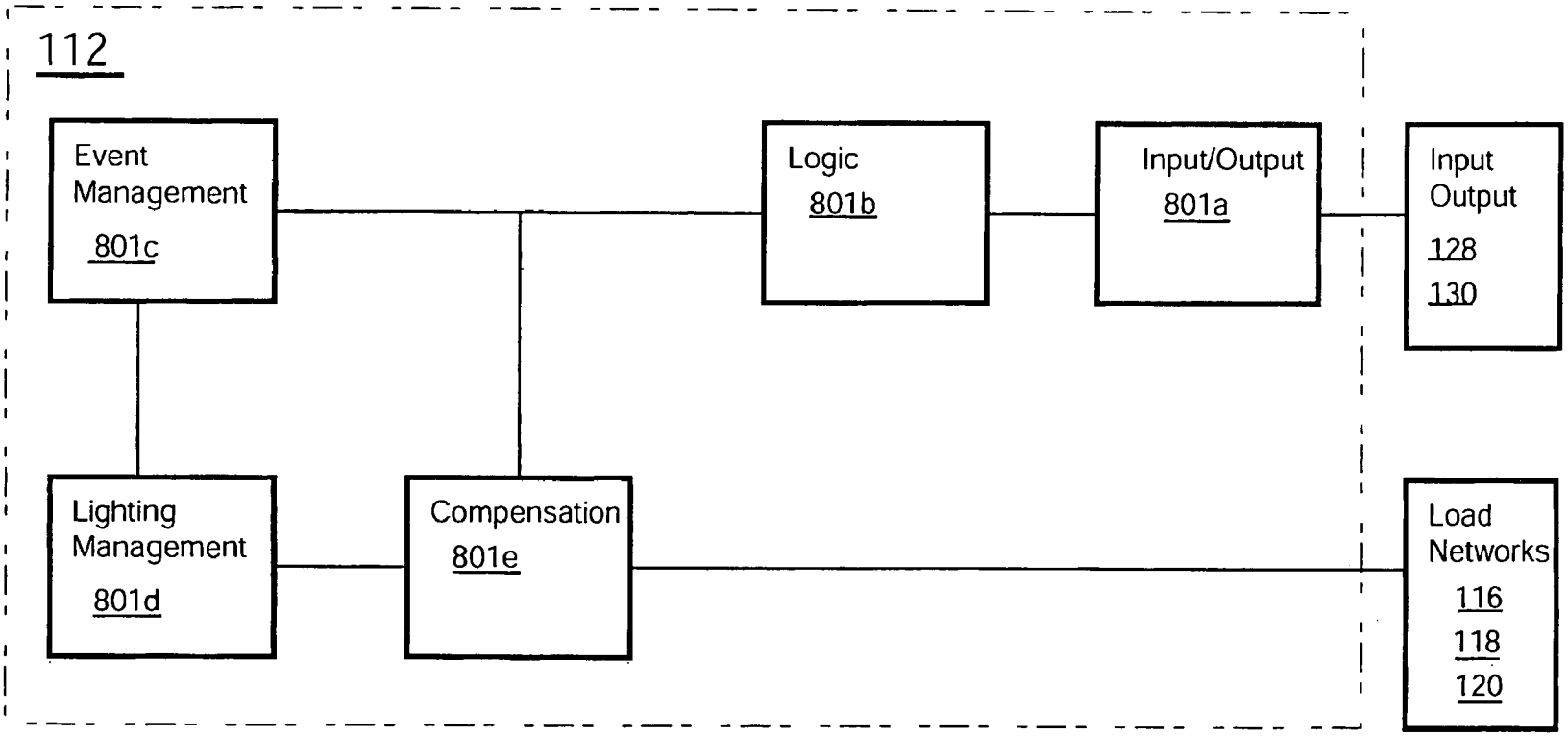
FIG. 8*a* is a block diagram of another embodiment of a controller of the lighting system of FIG. 1.

FIG. 8*a* shows another embodiment 800*a* of the controller 122. Here, an input output section 801*a* exchanges signals with external input/output devices 128, 130 and a compensation section 801*e* exchanges signals with load networks 116, 118, 120. A logic section 801*b* has signal level interconnections with both of an event management block 801*c* and the compensation section. The event management section and the compensation sections also have signal level interconnections with a lighting management section 801*d*. It is an advantage of such embodiments that one or more sections 801*a-e* is implemented with a digital processing device in conjunction with appropriate software enabling addition, deletion or enhancement of functions.

Figure 8B:
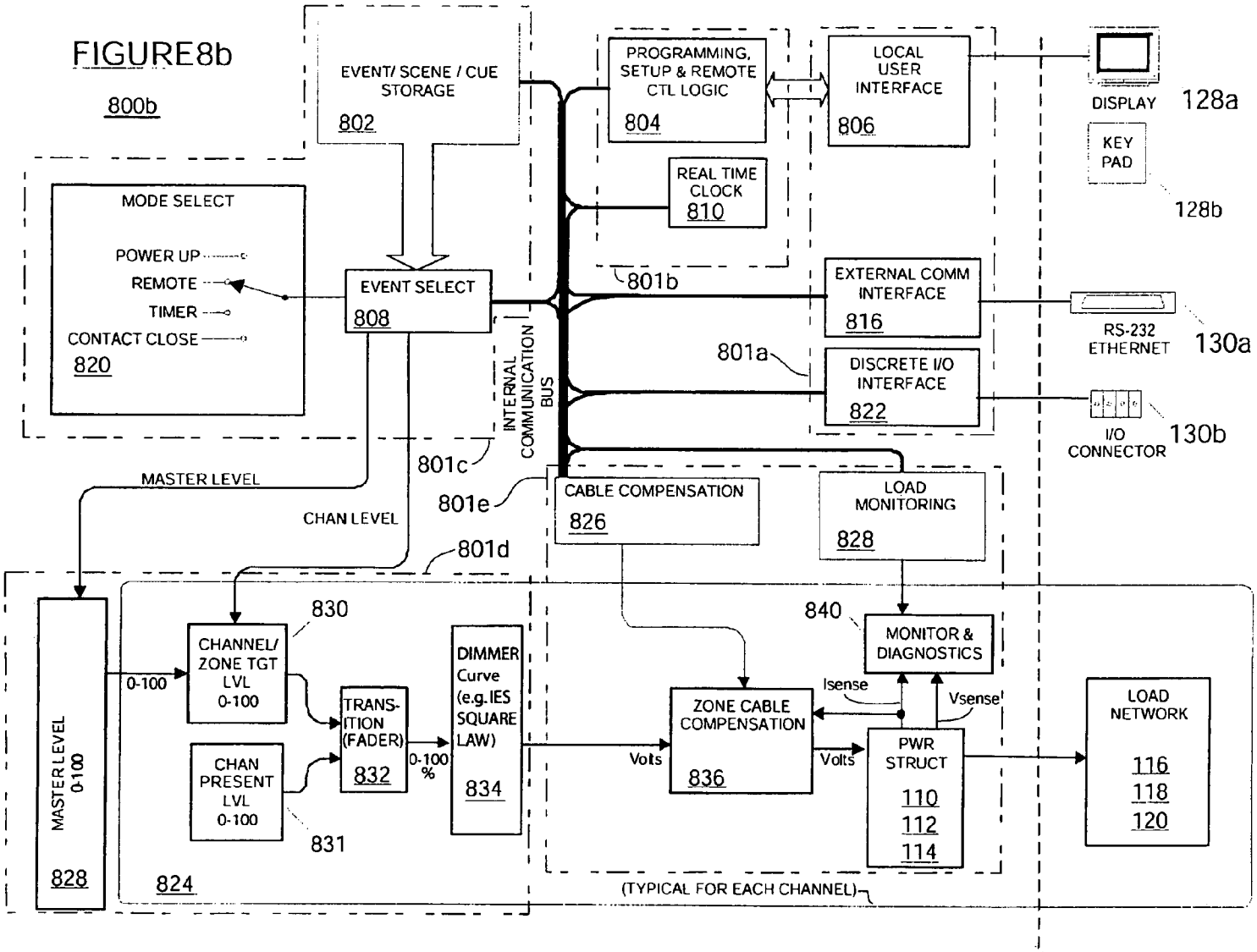
FIG. 8*b* is a block diagram of yet another embodiment of a controller of the lighting system of FIG. 1.

FIG. 8*b* shows another embodiment 800*b* of the controller 122. In this embodiment, each of the sections of FIG. 800*a* is realized through a combination of elements and/or functions. Input/output section 801*a* includes a local user interface 806 that is interconnected with a keyboard 128*b* and a display 128*a*, an external communications interface 816 that is interconnected with a digital port 130*a*, and a discrete input/output interface 822 that is interconnected with a terminal strip 130*b*.

The logic section 801*b* includes a programming, setup, remote control, logic device (PSRL) 804 and a real time clock 810. The PSRL exchanges signals with the local user interface 806 and the external communications interface 816 to provide for local and remote configuration, setup and monitoring of the controller 800 and associated devices. In one embodiment setup, programming and monitoring can be accomplished remotely using an interface, for example an Internet web browser. The real time clock 810 maintains current time and can be used to activate or deactivate network loads or activate scenes at preset times of day. Additionally, the real time clock 810 can be used in conjunction with a table of local seasonal sunrise and sunset times to trigger changes at sunrise and sunset.

The event management section 801*c* (EMS) includes an event/scene/cue storage module 802, an event selector 808, and a mode selector 820. The EMS can be used to program responses to triggers, such that the controller will activate a preset scene or change a zone level in response to a corresponding trigger or condition. For example a trigger may be chosen to be a remote contact closure, a sensor input detecting daylight or motion, a clock time, or a receipt of a specific remote communication message. The setting of mode determined by selector 820 can determine what action is taken in response to a trigger. Thus the event select 808 receives input from the real time clock 810, the external communication interface 816, the discrete input/output interface 822 and the mode selector 820.

As a person of ordinary skill in the art will understand, any one or more of the network power supplies 110, 112, 114 may be used to operate lighting or other devices associated with particular zones, channels, or channel zones such as lighting zones in a landscape lighting system. The zones may be operated independently or as explained below, their operation may be coordinated, biased and/or otherwise controlled through the use of master controls.

The lighting management section 801*d* (LMS) includes a master level device 828 that receives input from the event selector, affecting all zone levels. A channel zone target level module 820 receives input from both the master level device and the event selector. In operation, the LMS can set the output of each zone to any desired level for the purpose of creating a look or function. Additionally the LMS in conjunction with the EMS can provide transitions between scenes or looks. For example, all lights in the system can be programmed to fade out gradually over a 20 minute interval at sunrise. Additionally security lights can be programmed to fade up in one second in response to a motion detector. Transition fader 832 provides timed cross fades between the present channel level 831 and channel zone target level 830. Dimmer curve module 834 receives the level input from the transition fader module. Many light sources commonly found in the load network exhibit non-linear characteristics in response to a linear change in voltage. Thus a smooth fade between intensity levels cannot be accomplished by a linear transition in voltage levels. For example incandescent lights have an exponential voltage/intensity relationship.

It is also the case that voltage levels often do not correspond well with intensity levels. For example, a typical incandescent lamp operated at 50% rated voltage will produce less than 10% rated intensity, while 50% rated intensity is reached at 82% rated voltage. Dimmer curve module 834 can be set to compensate for this by implementing various dimmer curve functions. Many predefined dimmer curves exist. A common dimmer curve for incandescent light dimming compensation is the Illumination Engineering Society (IES) square law function. Different compensation curves can be implemented in module 834 to compensate for different load network light source characteristics, for example LEDs.

The compensation section 801*e* includes a cable compensation device 828, a load monitoring module 828, a zone cable compensation device 836, a monitor and diagnostics device 840, and interconnections with the power structures 110, 112, 114 and load networks 116, 118, 120. The zone cable compensation device 836 receives input from the dimmer curve module 834. The voltage compensation module also receives current sensor feedback data from a power structure 110, 112, 114 and cable resistance information from cable compensation module 826. As explained in conjunction with FIG. 9, this data can be used to derive a voltage command that is sent to a power structure 500, 500*a*, 600, 600*a*, 700, 700*a* to control the voltage output of one or more network power supplies 110, 112, 114 provided to respective network loads 116, 118, 120.

Isense and Vsense signals from respective network power supplies 110, 112, 114 (see FIGS. 5*a* and 7*a*) are received by the monitor and diagnostics device 840. The load monitoring module 828 compares the voltage and current reading with expected, recent, and historical values. These comparisons can be used to detect lamp failures or changes to the load network.

As a person of ordinary skill in the art will recognize, the controller 800 may be interfaced with other systems using hardwired or wireless communications techniques and systems such as those mentioned above. The controller may also be adapted to interface with other system including home automation systems, home computers, and internet or other networks using known networking techniques.

In operation, the electric voltage, current, and power waveforms at the power output of a particular network power supply 110, 112, 114 are influenced by the power structure 500, 500*a*, 600, 600*a*, 700, 700*a* chosen, the electrical characteristics of the respective load network 116, 118, 120 and the actions taken by the controller 122. Each of the power structures is capable providing, within a power range, a variable power output in response to actions taken by the controller.

A lighting system 100 configured with the first power structure 500 provides a chopped DC output with a variable duty cycle at the outputs of the DC to DC converters which form respective network power supplies 110, 112, 114 supplying power to respective load networks 116, 118, 120. As realized in power structure 500*a*, a chopped DC output with a variable duty cycle is provided at the inputs of respective intermediate networks N1, N2, N3. In an embodiment, the intermediate networks are filters that condition the output of the network power supply and in some embodiments the filter reduces the radio frequency energy radiated by trunk 306 and branch 412, 414 conductors.

A lighting system 100 configured with the second power structure 600 provides a chopped DC output with a variable duty cycle at the outputs of the DC to DC converters which form respective network power supplies 110, 112, 114 supplying power to respective load networks 116, 118, 120. As realized in power structure 600*a*, a chopped DC output with a variable duty cycle is provided at the inputs of respective intermediate networks N1, N2, N3. In an embodiment, the intermediate networks are filters that condition the output of the network power supply and in some embodiments the filter reduces the radio frequency energy radiated by trunk 306 and branch 412, 414 conductors.

A lighting system 100 configured with the third power structure 700 provides a non-sinusoidal AC output with a variable duty cycle from a secondary winding of a transformer. As realized in power structure 700*a*, a non-sinusoidal AC output with a variable duty cycle is provided at the input of an intermediate network N1. In an embodiment, the intermediate network is a filter that conditions the output of the network power supply and in some embodiments the filter reduces the radio frequency energy radiated by trunk 306 and branch 412, 414 conductors.

The power structures 500, 500*a*, 600, 600*a*, 700, 700*a* enable independent control of the output voltage, current, or power from each of the network power supplies 110, 112, 114. This independent control of each network power supply provides a means for, inter alia, maximizing and/or optimizing the power transfer in the trunk and branch circuits, compensating for varying loads in the load networks, and independently controlling zones supported by the lighting system 100.

Non-sinusoidal output waveforms available at the outputs of the power structures of the present invention 500, 500*a*, 600, 600*a*, 700, 700*a* provide better utilization and/or optimization of the power transfer capability of the conductors interconnecting a network power supply 110 with respective loads 302, 402, 404. This benefit results since the sinusoidal waveform has a ratio of maximum instantaneous voltage to Root Mean Square (RMS) voltage that is fixed at approximately 1.4142136 while non-sinusoidal waveforms may achieve maximum instantaneous to RMS voltage ratios of approximately 1.0. For example, in a voltage limited circuit intended to transfer electric power, operation of the circuit at the limiting voltage and at a maximum instantaneous to RMS voltage ratio of unity will maximize the circuit's power transfer capability. Therefore a power supply having a non-sinusoidal output waveform is superior to a sinusoidal supply because it reduces the size or gauge of the interconnecting conductors required to adequately supply a selected load. Further, use of a non-sinusoidal power supply output is of particular importance for voltage limited and/or low voltage load networks such as landscape lighting systems covered by UL Standard 1838; here, reducing the maximum instantaneous to RMS voltage ratio increases the power that can be delivered through a given size of conductor without exceeding a voltage limitation.

The variable voltage waveforms available at the outputs of the power structures 500, 500*a*, 600, 600*a*, 700, 700*a*, whether non-sinusoidal or not, enable automated voltage compensation and control for selected load networks 116, 118, 120. Such compensation and control is desirable since, inter alia, the electrical load presented by a particular load network is highly variable due to the quantity and rating of discrete loads such as lighting device loads, the resistance of interconnecting circuits such as the trunk 306 and branch 412, 414 circuits, and the connection resistances such as those at the interconnection of conductors at the input of a load distribution network 409.

In an embodiment, the loads 302, 402, 404 within a load network have inferable electrical characteristics which are distinguishable from those of the interconnecting conductors, such as a relationship between voltage and current. Here, the power structures 500, 500*a*, 600, 600*a*, 700, 700*a* in combination with the controller 122 provide auto-sensing of the appropriate voltage to be set at the network power supply output Vxy and/or at the load network input 304. As an example, incandescent lighting devices such as those with tungsten type filaments have a characteristic relationship between applied voltage and current response during startup. Increasing the voltage increases the temperature of the filament. Increasing filament temperature increases filament resistance. This characteristic is responsible for current inrush during startup of such devices. It is also a basis for implementing an auto-sensing feature for voltage control. In addition, the present invention enables current inrush to be controlled and thereby extends the life of devices whose lifetime would otherwise be prematurely consumed by uncontrolled current inrush. In an embodiment, the auto-sensing and soft-start functions are performed substantially simultaneously.

For example, a lighting device with a tungsten filament has a voltage-current relationship as measured at its terminals that is described by $$I=Inom\times(V/Vnom)\hat{}0.55$$

where I and V are the voltage and current respectively and Inom and Vnom are constants associated with the lighting device corresponding to the current through and potential across the input terminals of the lighting device at a design operating point. Where an electric circuit such as a trunk circuit 306 interconnects a lighting device 302 and a network power supply 110, the following relationship predicts Vsource where $$Vsource=Isource\times Rcircuit+Isource\hat{}1.818\times(Vnom/Inom\hat{}1.818)$$

where Vsource and Isource are the voltage and current at the input of a respective load network, Rcircuit is the resistance or impedance of the interconnecting circuit, and Vnom and Inom are constants associated with the lighting device corresponding to the current through and the potential across the input terminals of the lighting device at a design operating point. Vsource and Isource are measured or indicated by the controller 122 and correspond to Vsense and Isense. When Vnom is known, a system of two equations can be written and solved for Rcircuit and Inom when two values of Vsource and the corresponding values of Isource are known. As a person of ordinary skill in the art will recognize, there are many ways to obtain solutions and approximate solutions for the above equations and for equations that describe similar electrical circuits interconnecting devices having known startup characteristics.

In one embodiment of the compensation and control, system and method, of the lighting system 100, both start-up and regulation modes of operation are implemented. As will be understood by persons of skill in the art, the equations above provide several means to implement control algorithms including algorithms based on voltage, current, and power. As an example, in a startup mode of a particular network power supply 110 and load network 116 comprising a trunk circuit 306 and a load 302, at least two data sets (Vsense1, Isense1 and Vsense2, Isense2) corresponding to respective voltage waveforms at the output of the network power supply are collected. Each data set includes an indication of Vsource and Isource as measured at the input of the load network. This allows solution of the Vsource equation above for Inom and Rcircuit. From this data, an initial voltage setpoint is calculated as:

$$Vsetpoint1=Inom\times(Rcircuit+(Vnom/Inom)).$$

The voltage input to the load network is set to Vsetpoint1, the values of Rcircuit and Inom are saved, and the controller enters a regulation mode. It will be appreciated that there are a number of similar methods for obtaining the value of Rcircuit in accordance with the embodiments described.

Figure 9:
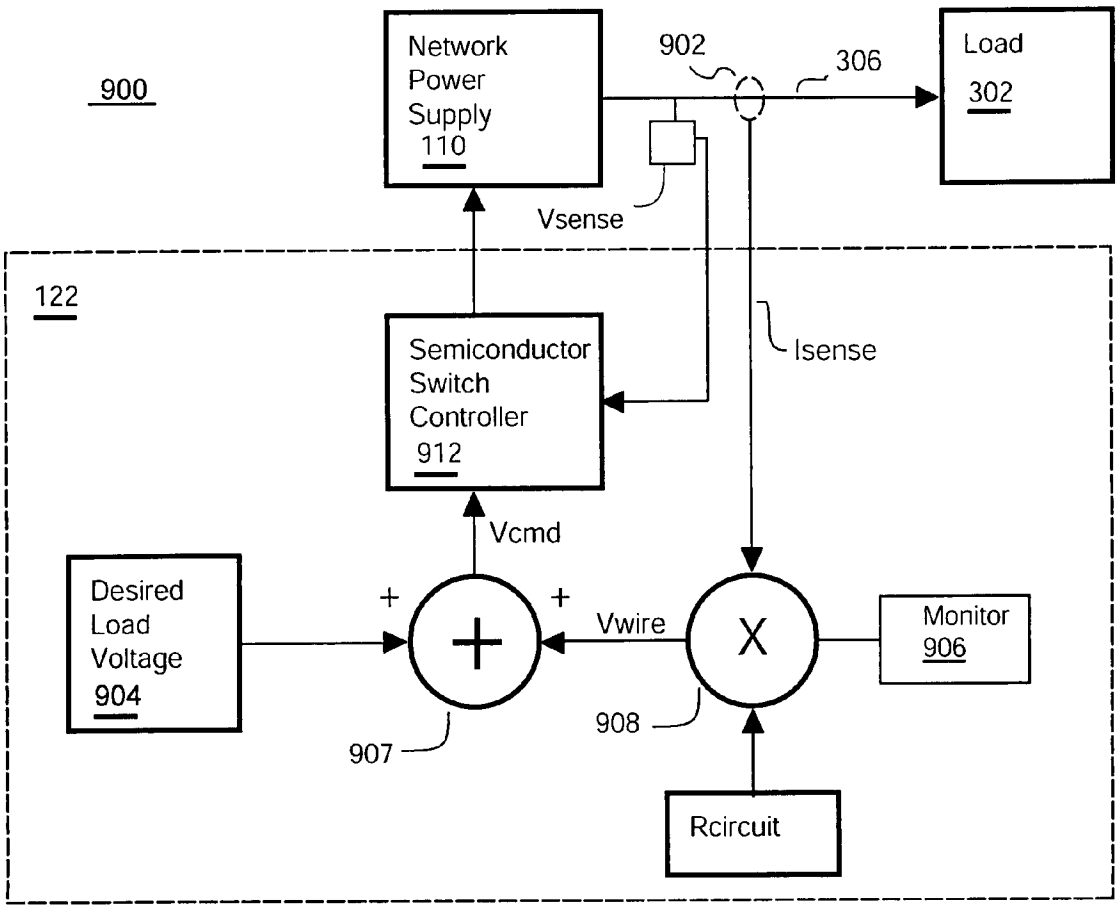
FIG. 9 is a block diagram of a system and method of control of the lighting system of FIG. 1.

FIG. 9 is a schematic diagram of an exemplary regulating system and method 900 of the lighting system 100. Here, as above, the voltage supplied to the load network 116 is regulated without direct measurement of the voltage at the load 302. The regulator monitors current in the trunk circuit Isense and a desired load voltage input 904. The regulator responds to changes in either of these values by adjusting the voltage waveform at the output of the network power supply 110. Voltage drop in the trunk circuit 306 is calculated in a junction 908 where Rcircuit is multiplied by Isense to produce a trunk circuit voltage drop value Vwire. In operation, a desired load voltage such as the voltage rating of an electric lighting device is provided to summing junction 907. The summing junction adds the desired load voltage to an estimate of the voltage drop in the trunk circuit Vwire to produce a command voltage signal Vcmd. A semiconductor switch controller 912 receives the command voltage signal and provides one or more semiconductor switch control outputs Tswitch to the network power supply and in some embodiments to other switches within the power structure. In response to the semiconductor switch control outputs, the output of the network power supply is adjusted to achieve the commanded voltage at the input of the load network 308, 408.

In an embodiment, the regulator 900 operates as a closed loop controller. If the current through the trunk circuit 306 increases, the voltage drop in the trunk circuit increases, decreasing the voltage supplied to the load 302. However, the current increase will increase Isense and result in a control action to increase the voltage output of the network power supply 110. This voltage increase compensates for the change by restoring the voltage supplied to the load 302 to the desired value. Similarly, if the current through the trunk circuit decreases, control action will be taken to reduce the voltage at the output of the network power supply to maintain the desired voltage at the load 302.

When the load presented by load 302 and the desired load voltage 904 remain unchanged, a steady-state operating condition is reached. During this steady-state, a substantially constant value of Isense results. In an embodiment, a monitor 906 saves the steady or historic Isense value and compares later values to it. Differences between historic and later current flows detected by the monitor are then used to detect anomalies such as lamp failure, wire breakage, connection deterioration, or addition or removal of loads. The controller 122 may report such occurrences to the user or others via the man-machine interface 128 or via digital connections 130.

In an embodiment, the lighting system 100 has at least one network power supply 110, 112, 114 supplying power to a respective load network 116, 118, 120 that includes a distribution network 409 as shown in FIG. 4*a*. As a person of ordinary skill in the art will appreciate, utilization of radial branch circuits 412, 414 having similar resistances that are also relatively small as compared to the resistance of the trunk circuit 306 facilitates the application of the aforementioned automatic compensation and control functions. As an example, when the branch circuits have similar ohm per foot values, the radiuses r1, r2 may be chosen to achieve this result.

The auto-sensing feature enables a lighting system installer to reduce the installation time by avoiding the trial and error manipulation of loads and wire gauge/length to achieve appropriate voltages throughout the system. Upon startup, the network power supplies 110, 112, 114 supporting auto-sensing loads such as lighting devices with tungsten filaments will automatically adjust their output voltages 304 to accommodate varying loads 302, 402, 404, conductor 306, 412, 414 lengths and connection resistances.

In an embodiment, auto-sensing is not used. Here, controller 800 provides for interconnecting conductor 306, 412, 414 and load 302, 402, 404 compensation based on values that are stored in the controller at, for example, the time of lighting system 100 installation. In one embodiment of this compensation method, the user enters load network 116, 118, 120 data such as loads and/or cable data. Conductor sizes/gauges and lengths are entered into the cable compensation table 826 via the user interface 806. The user also enters the discrete load(s) into the expected loads table 828 via the user interface 806. The zone cable compensation device 836 calculates the voltage drop in the conductors and sets the network power supply output voltage 304 to equal nominal device voltage plus conductor voltage drop.

In an embodiment, the lighting system 100 creates scenes. The network power supplies 110, 112, 114 provide variable voltage outputs and therefore lighting device intensities. Each of the power structures 500, 500*a*, 600, 600*a*, 700, 700*a* enable independent control of respective interconnected loads 302, 402, 404. The event/scene/cue list table 802 in controller 800 provides a menu of saved light shows. The light shows include defined zone selections and zone intensities and shows where zone selections and zone intensities are varied to produce multiple effects including changes in color. Other shows dynamically select zones and their intensities to create an ambiance of the user's choice and in some embodiments sensor 132 indications provided to the controller 122, 800*b* is a basis for selecting zones and zone intensities for particular shows.

Independent control of multiple network power supplies that serve multiple zones, channels, or channel zones provides a facility to create scenes of various intensities, durations, and colors that please onlookers.

Figure 10:
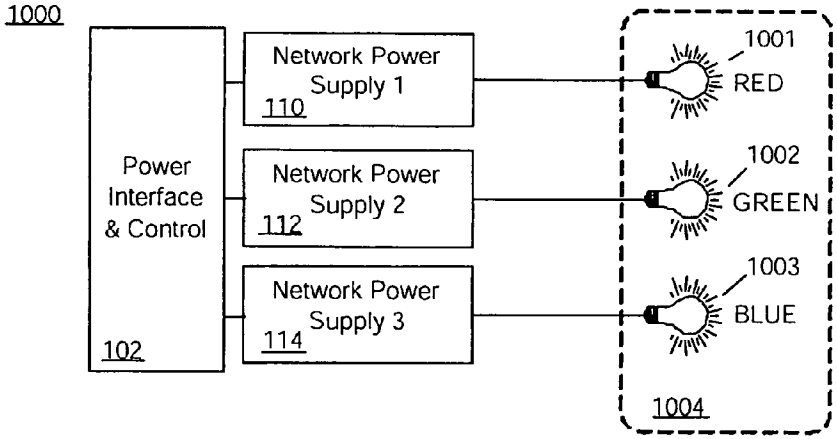
FIG. 10 is a block diagram of an embodiment of the lighting system of FIG. 1 utilizing colored lights.

FIG. 10 shows an embodiment 1000 of the lighting system 100 wherein first, second, and third network power supplies 110, 112, 114 power respective red, green, and blue lighting devices for use in multiple zones or channels. The three lighting devices are physically located 1004 such that the light emitted from the sources is blended. It is well-known that blending light from two sources emitting different colors can produce a variety of apparent colors of light by varying the relative intensity of the two sources. When three or four lights are similarly blended, the variety of apparent colors can be even greater. Often a set of lighting devices is selectively colored to enable production of a wide range of colors when they are blended. A common arrangement is a set of three lighting devices comprising red, green and blue light sources, corresponding to additive primary colors. With such a system a wide range of hue and saturation of color can be produced by varying the intensity of each of the three colored lights.

An additional feature provided by this embodiment in combination with the compensation and control methods mentioned above is that the intensity of each source can be controlled precisely because the voltage at the source can be controlled. Most conventional systems do not provide dimming capability. Conventional systems, including those that provide dimming control, do not compensate for the cable length and wire-gauge of circuits connecting the network power supply and load. Thus in conventional systems creation of a desired color mix typically requires time-consuming trial-and-error solutions and any change to the system may upset the blend. Further, in conventional systems the reproduction of a particular color mix may be difficult to achieve from one system to the next. In the present embodiment consistent and reproducible color mixes are easily achievable.

Figure 10A:
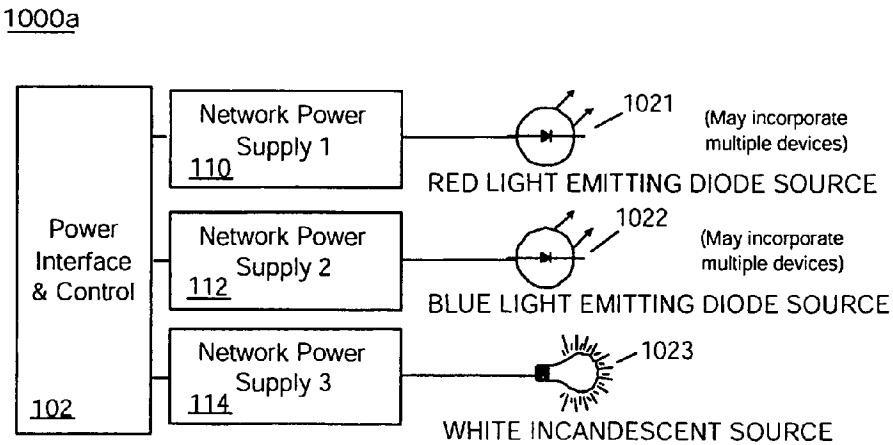
FIG. 10*a* is a block diagram of an embodiment of the lighting system of FIG. 1 utilizing LED and incandescent lighting devices.

FIG. 10*a* is another embodiment 1000*a* of the lighting system 100. Here, both LED and incandescent loads are interconnected with respective network power supplies 110, 112, 114. Since LED loads typically require different control and regulation than incandescent loads, the network power supplies powering LED's 110, 112 are controlled and/or configured to drive LED loads. As shown, first and second network power supplies 110, 112 power respective red and blue LED's and a third network power supply supplies power to a white incandescent lighting device. Since the network power supplies are coupled to a common control means 122, the different types of loads can be used in concert. Therefore, this embodiment provides coordination and/or biasing of multiple lighting device technologies to produce varying color, intensity, and timing effects all of which are under common control.

Figure 10B:
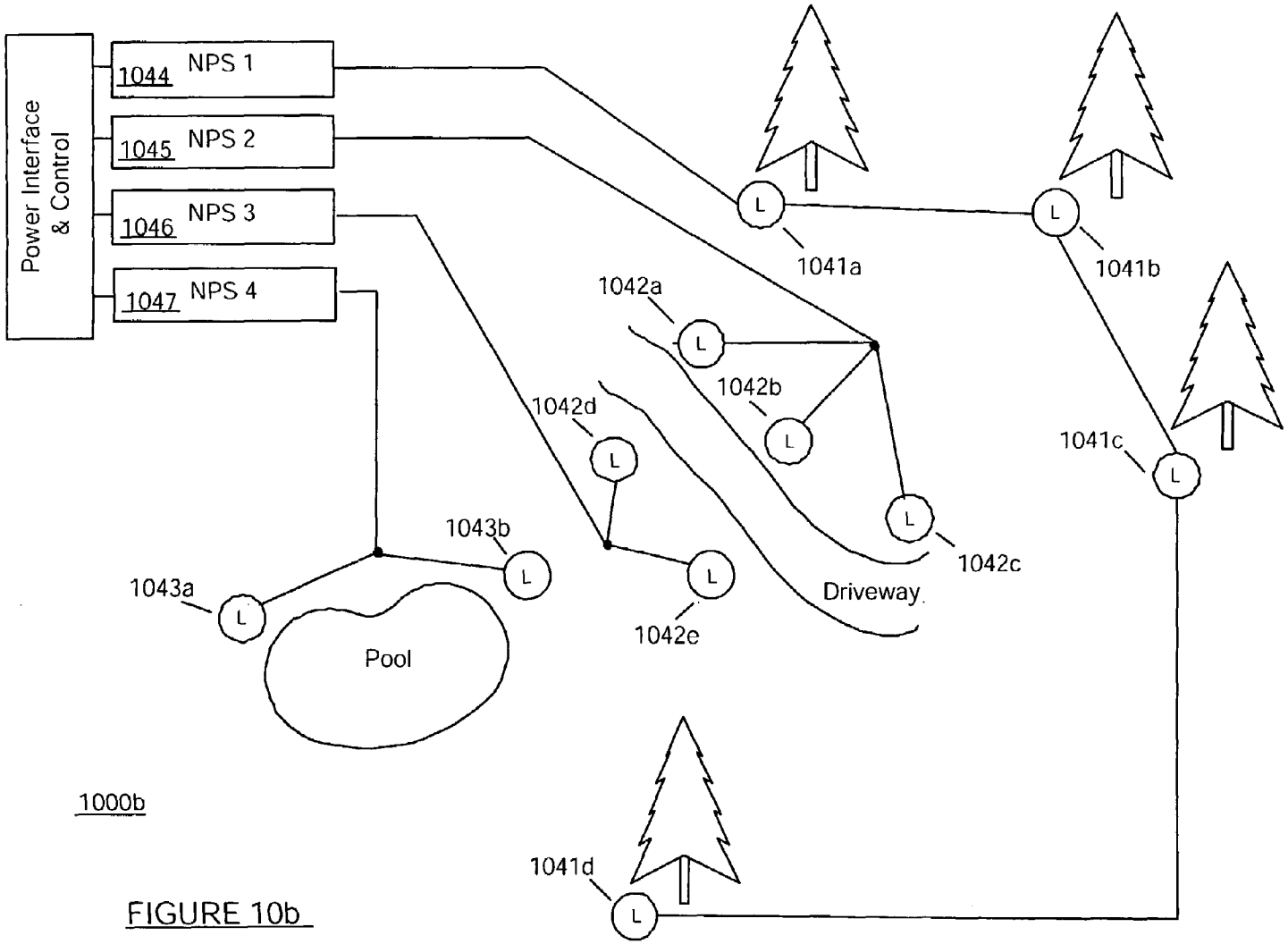
FIG. 10*b* is an embodiment of the lighting system of FIG. 1 having multiple zones.

FIG. 10*b* in yet another embodiment 1000*b* if the lighting system 100. In this embodiment a landscape lighting plan 1040 includes lighting for trees, a pool, and a driveway. Given these uses, it is often desirable to group the lighting devices in a manner that allows for control by location, feature type, or other criteria. In particular, a first network power supply 1044 provides power to tree illumination lighting devices 1041*a*, 1041*b*, 1041*c*, 1041*d*. A second network power supply 1045 provides power to driveway lighting devices 1042*a*, 1042*b* and 1042*c*. Driveway lighting devices 1042*d* and 1042*e* are powered by a third network power supply 1046 and pool lighting devices 1043*a* and 1043*b* are powered by a fourth network power supply 1047.

Since each of the network power supplies has a controlled voltage, current, and/or power output that is independent of the outputs of other network power, the lighting devices in multiple physical areas, zones, channels, or channel zones can be controlled independently or coordinated and/or biased to achieve the desired effects. For example, it may be desirable to have the trees illuminated at a low level during the night. But, it may be desirable to turn on the driveway lights or to increase their brightness in response to a sensor capable of detecting an approaching vehicle. Similarly, it may be desirable to activate the pool lights only when the pool is in use during the nighttime.

As shown in FIG. 10 *b*, three driveway lighting devices 1042*a*, 1042*b*, 1042*c* are powered by a first network power supply 1045 and two driveway lighting devices 1042*d*, 1042*e* are powered by a second network power supply 1046. Such a configuration may be necessary to distribute the load among multiple network power supplies no one of which has sufficient capacity to power all five lighting devices. Nevertheless, the two network power supplies 1045, 1046 may be grouped within one or multiple controllers in signal communication such that all five lights are controlled as one logical control group.

Figure 11:
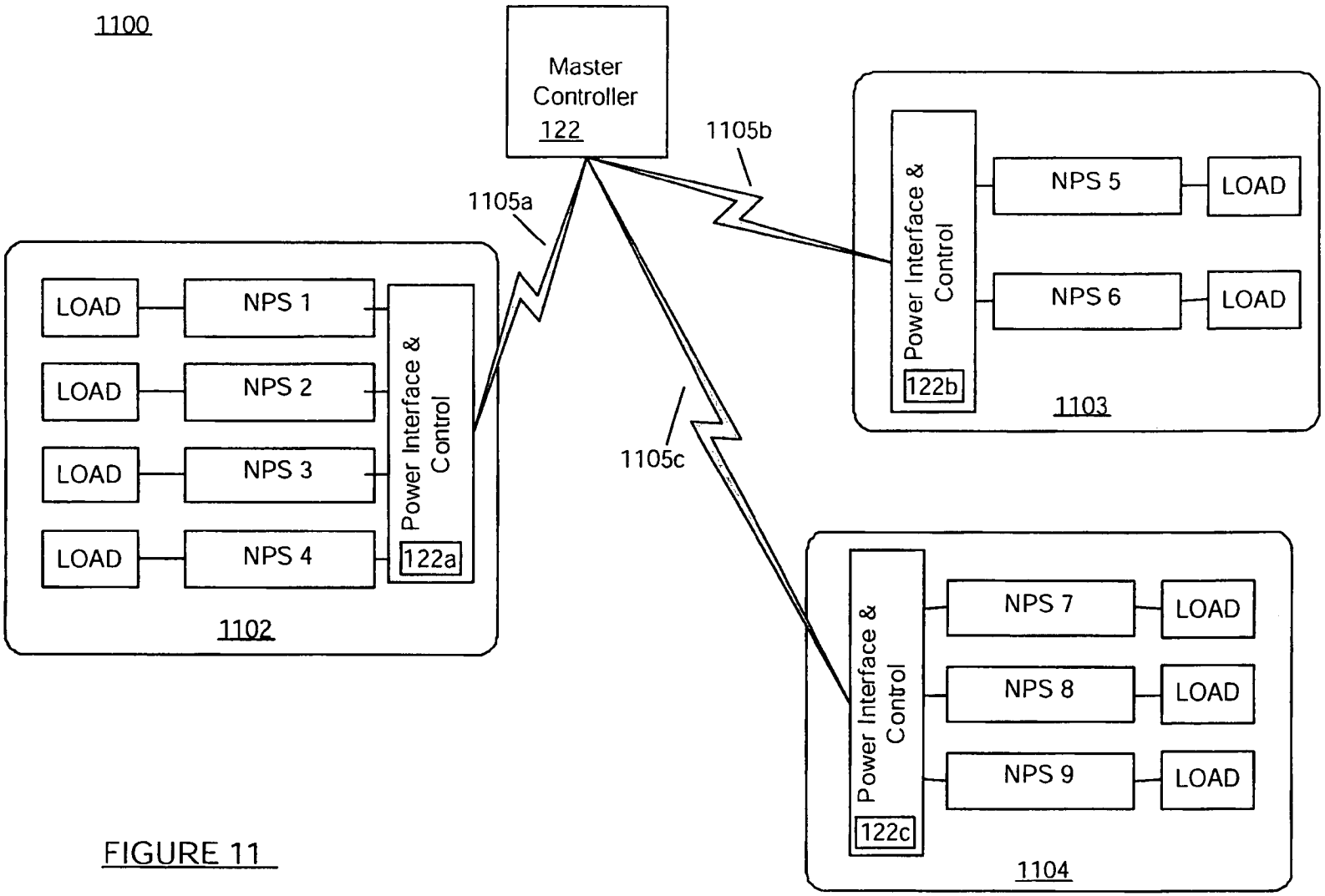
FIG. 11 is an embodiment of the lighting system of FIG. 1 having distributed controls.

FIG. 11 shows an embodiment 1100 of the lighting system 100 utilizing distributed control. Here, the controller 122 is distributed and encompasses a master controller 122 and distributed controllers 122*a-c*. In this embodiment communication links 1105*a-c* interconnect the master controller with respective distributed controllers. The interconnection may be either hardwired or wireless using any one or more of the interconnection solutions mentioned above. As shown, each of three distributed lighting systems 1102, 1103, 1104 have respective controllers 122*a-c*. The first distributed lighting system includes four network power supplies NPS1-4, the second distributed lighting system includes two network power supplies NPS5-6, and the third distributed lighting system includes three network power supplies NPS7-9. The master controller sends and receives commands to operate the nine network power supplies in concert. This topology of controllers and network power supplies supports control of the network power supplies as totally independent, coordinated, and/or biased power supplies regardless of how the distributed lighting systems are physically configured. Therefore, the installer may adapt the physical configuration to optimize other factors such as wire lengths and/or aesthetics. In other embodiments, the number of distributed lighting subsystems, network power supplies, distributed controllers, and master controllers may be varied to suit the demands of a particular project.

In some embodiments, the master controller 1101 is included with one of the distributed lighting systems 1102, 1103 or 1104. In other embodiments, the master controller 1101 is physically separate. In various embodiments the communication links 1105*a-c* are implemented using diverse connections and protocols as mentioned above and as would be obvious to a person of ordinary skill in the art. For example, the communications links may use dedicated wire connections in a bus, star, daisy chain or ring topology. Alternatively, the communications links may connect using a shared network, such as Ethernet. The communications may also be implemented using a wireless link and protocol as described above.

FIGS. 12 and 12*a* show first 1200 and second 1200*a* embodiments of one or more lighting assemblies. Selected components in these assemblies have different characteristics as shown to illustrate features and benefits of the present invention. A first lighting assembly 1210 includes a power source 1211, a lighting device or load 1213, and an electrical interconnection between the source and the load 1212. For illustration, a 30 watt load is used and the resistance of the interconnection is 1 ohm. A second lighting assembly 1220 includes a power source 1221, a lighting device or load 1223, and an interconnection between the source and load 1222. For illustration, the load is 50 watts and the resistance of the interconnection is 2 ohms. While two lighting assemblies are shown for simplicity, the technique described may be extended to a large number of lighting assemblies. Other parameters including connection resistance, load wattage and nominal voltage of load devices have also been chosen arbitrarily and for purposes of illustration only.

FIG. 12*b* shows a table of lighting assembly parameters when the lighting assemblies 1210, 1220 are operating at a steady state condition and the lighting device voltages are at a nominal value. Here, 12 volts is the nominal lighting device voltage and it can be seen that the corresponding supply voltage is greater than 12 volts; this is due to the resistance of the interconnection.

When it is desired to reduce the lamp voltage by half, the typical approach is to reduce the source voltage by half. The reduction may be to reduce intensity, prolong lamp life, or achieve color mixing or other effects. But, this typical approach taken in many conventional systems produces poor results as shown by comparing Table 12*a* and Table 12*b*. At least two problems arise. First, neither lamp voltage reaches the desired 6 volt level which is half of its prior 12 volt setting. Second, and importantly, the lamp voltages now differ between the two assemblies. The intensities and color temperature will also differ so that the lamps will no longer appear identical in either their color or intensity. Those familiar with the art will appreciate that incandescent lamp characteristics vary significantly as a function of applied voltage and that relatively small differences in applied voltage among lighting devices can be very noticeable to a human observer and particularly troublesome to photographers or cinematographers.

FIG. 12*c* shows another approach. In this case, the source voltage has again been reduced by an equal percentage in both assemblies, approximately 47 percent. Reduction of all voltages by the same percentage is often the only dimming option in conventional systems. In this case the voltage reduction has been selected such that the lamp voltage in circuit 1 is the desired 6 volts. However, due to non-linear variation of current and voltage, reducing the source voltage in the second lighting assembly by the same percentage as in the first lighting assembly does not result in the desired 6 volt value at the respective loads. Again, the lamps will differ significantly in intensity and color appearance.

FIG. 12*d* shows an embodiment in accordance with the present invention. This embodiment overcomes the above-mentioned limitations. Here, the two circuits correspond to two zones having separate network power supplies and the network power supplies are interconnected with a power, interface, and control 102 block (not shown). In accordance with the present invention, the resistance of the circuit Rcircuit interconnecting the network power supply and the lighting device is inferred. Where, for example, it is desired to reduce the light output of a particular tungsten-halogen lighting device to 8.8 percent of its former value, the voltage supplied to the lighting device must be reduced to approximately 50% of its previous value. Designating the initial and final states as 1 and 2, the present invention achieves this result by using stored values indicating Vnom, Inom, Rcircuit, Vsource1 and Isource1 and solving the following equations:

$$V\text{source}2 = I\text{source}2 * R\text{circuit} + V\text{lamp}2$$

where $$V\text{lamp}1 = (V\text{source}1 - (I\text{source}1 * R\text{circuit}))$$

and $$V\text{lamp}2 = 0.5 * V\text{lamp}1$$

and $$I\text{source}2 = (Inom * ((V\text{lamp}2/Vnom)\hat{}0.55)$$

In another embodiment, a value of Vlamp2 is chosen and the regulator of FIG. 9 is utilized to set the output Vsource2. Here, the following equations are solved:

$$I\text{source}2 = Inom * (V\text{lamp}2/Vnom)\hat{}0.55$$

$$V\text{source}2 = R\text{circuit} * Inom * (V\text{lamp}2/Vnom)\hat{}0.55 + 0.5 * V\text{lamp}1$$

Note that an indication of the actual current may be used in place of the term (Inom*(Vlamp2/Vnom)^0.55).

Using these systems and methods, the voltage supplied at a lighting device can be automatically controlled to achieve the desired light output without undesirable variations in light output, intensity, and color temperature. Moreover, multiple lighting subsystems are adjustable to achieve the same light outputs by their respective lighting devices or to achieve selected but different light outputs. As mentioned above, a person of ordinary skill in the art will recognize that the present invention may be implemented using other equations and solution methodologies. Each of these variations is another embodiment of the present invention.

An additional benefit of this embodiment is that the desired voltage will be maintained, within the capability of the source, irrespective of the resistance of the interconnecting circuit Rcircuit or the load. In a conventional system, changing the load or interconnecting circuit typically affects the voltage at the lighting devices and thus the appearance of these devices.

The embodiments described herein enable a user to select particular lighting effects in particular zones. The variations comprising the effect include on/off, intensity, and color where the effect chosen in a first zone is independent of or coordinated with or used to bias the effect chosen in a second zone. These independently controlled effects may be used to create various looks or scene presets that rely on precise lighting device voltages or relationships between lighting devices where there are one or more network power supplies powering lighting devices within one or more zones, channels, or channel zones. As a person of ordinary skill in the art will understand, embodiments of the present invention will also support a lighting device that comprises a plurality of discrete lighting devices whether they are substantially collocated or not.

Obviously, numerous modifications and variations of the present invention are possible in light of the above teachings. It is therefore to be understood that within the scope of the appended claims, the invention may be practiced otherwise than as is specifically described herein.

What is claimed is:

1. A method of reducing the quantity of conductor required to implement a low voltage, voltage limited lighting system comprising the steps of:

coupling a power output of a first electrical network to a power input of a second electrical network, the first electrical network receiving power from an alternating current source;

controlling a semiconductor switch within the first electrical network to vary, within a power range, the power exchanged between the first electrical network and the second electrical network; and, operating a low voltage electrical lighting device within the second electrical network from power supplied by the first electrical network wherein for at least a portion of the power range, the ratio of the maximum instantaneous voltage to the RMS voltage as measured at the power output is less than 1.414.

2. The method of claim 1, wherein the semiconductor switch is switched at a frequency greater than twice the frequency of the AC power source.

3. The method of claim 1, wherein the semiconductor switch is switched at a frequency greater than five kilohertz.

4. The method of claim 1, wherein prior to entering the second network, the power flows through an electrical filter whose purpose includes reducing the harmonic energy transferred to the second network.

5. In a low voltage lighting system powered by an alternating current source, the improvement comprising:

a first electrical network having a power output coupled to a power input of a second electrical network, the first electrical network receiving power from an alternating current source;

a semiconductor switch within the first electrical network that is operative to vary, within a power range, the power exchanged between the first and the second electrical networks, the semiconductor switch being switched at a frequency greater than twice the frequency of the alternating current source; and, a low voltage electrical lighting device within the second electrical network receiving power supplied by the first electrical network wherein for at least a portion of the power range, the ratio of the maximum instantaneous voltage to the RMS voltage as measured at the power output is less than 1.414.

6. The lighting system of claim 5, wherein the semiconductor switch is switched at a frequency greater than 5 kilohertz.

7. The lighting system of claim 6, wherein prior to entering the second electrical network, the power flows through an electrical filter for the purpose of reducing the radiation of electromagnetic energy from the second network.

8. A method of regulating a remote electrical lighting device comprising the steps of:

coupling an electrical output of a variable power supply to an electrical input of a lighting network, the variable power supply receiving power from an alternating current source:

varying a waveform at the electrical output;

obtaining for a plurality of waveforms an indication of the corresponding voltages and currents at the lighting network input;

inferring an impedance of an electrical conductor within the lighting network from the indicated voltages and currents; and, utilizing the inferred impedance of the electrical conductor to regulate the power supplied to the lighting network; and, utilizing an electrical filter whose purpose includes reducing the harmonic energy transferred to the lighting network for filtering the power flowing to the lighting network.

9. A lighting system receiving power from an alternating current source comprising:

a plurality of network power supplies having respective electric power outputs that are coupled to electric power inputs of respective lighting networks;

each network power supply operative to supply a plurality of electric power waveforms to a respective lighting network;

a controller in signal communication with a plurality of the network power supplies and operative to select for each network power supply a particular electric power output waveform that is independent of the electric power output waveforms selected for other network power supplies; and, the controller for one or more network power supplies being operative to control a semiconductor switch within the network power supply to vary, within a power range, the power exchanged between the network power supply and a respective lighting network; and, the controller for one or more network power supplies being operative to operate a low voltage electrical lighting device within the lighting network from power supplied by the network power supply wherein for at least a portion of the power range, the ratio of the maximum instantaneous voltage to the RMS voltage as measured at the power output of the network power supply is less than 1.414.

10. The lighting system of claim 9, wherein for one or more network power supplies the controller is operative to:

control a semiconductor switch within the network power supply to vary, within a power range, the power exchanged between the network power supply and a respective lighting network; and, operate a low voltage electrical lighting device within the lighting network from power supplied by the network power supply wherein for at least a portion of the power range and as measured at the power output of the network power supply, the variations in RMS power supplied occur at a substantially constant value of maximum instantaneous voltage.

11. The lighting system of claim 9, wherein for one or more network power supplies the controller is operative to:

vary the waveform at an electrical output of the network power supply;

obtain for a plurality of waveforms an indication of the corresponding voltages and currents at the lighting network input;

infer an impedance of an electrical conductor within the lighting network from the indicated voltages and currents; and, utilize the inferred impedance of the electrical conductor to regulate the power supplied to the lighting network.

12. The lighting system of claim 11, wherein the semiconductor switch is switched at a frequency greater than twice the frequency of the alternating current power source.

13. The lighting system of claim 11, wherein the semiconductor switch is switched at a frequency greater than five kilohertz.

14. The lighting system of claim 11, wherein prior to entering the lighting network, the power flows through an electrical filter whose purpose includes reducing the harmonic energy transferred to the lighting network.

* * * * *